US006587660B2

(12) United States Patent
Ueno et al.

(10) Patent No.: US 6,587,660 B2
(45) Date of Patent: Jul. 1, 2003

(54) DEVELOPING APPARATUS

(75) Inventors: Takahito Ueno, Shizuoka (JP); Hisayoshi Kojima, Shizuoka (JP); Kazunari Murayama, Shizuoka (JP); Tadashi Horikawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/876,121

(22) Filed: Jun. 8, 2001

(65) Prior Publication Data

US 2002/0034403 A1 Mar. 21, 2002

(30) Foreign Application Priority Data

Jun. 9, 2000 (JP) ..... 2000-173662
Jun. 4, 2001 (JP) ..... 2001-167856

(51) Int. Cl.[7] ..... G03G 15/08

(52) U.S. Cl. ..... 399/252; 399/263; 399/111; 399/119

(58) Field of Search ..... 399/106, 111, 399/119, 254, 255, 256, 262, 263; 222/DIG. 1; 384/209, 210

(56) References Cited

U.S. PATENT DOCUMENTS 5,937,240 A * 8/1999 Kanno et al. ..... 399/111
6,088,561 A * 7/2000 Kawamura et al. ..... 399/262

FOREIGN PATENT DOCUMENTS

JP 11-102107 4/1999
JP 11-133738 5/1999

* cited by examiner

*Primary Examiner*—Hoang Ngo
(74) *Attorney, Agent, or Firm*—Fitzpatrick, Cella, Harper & Scinto

(57) ABSTRACT

A developing apparatus includes a developer container. An agitating member agitates developer contained in the developer container. A drive transmitting member transmits power to the agitating member by engaging a rotary shaft of the agitating member. A bearing is adapted to rotatably hold the drive transmitting member to the developer container. The bearing includes a notched portion having a rotation regulating and positioning function to prevent the bearing from being dislodged from the developer container.

8 Claims, 23 Drawing Sheets

DEVELOPING APPARATUS

BACKGROUND OF THE INVENTION

1. Field of the Invention

The present invention relates to a developing apparatus used with an image forming apparatus such as a copying machine, a printer and the like, and more particularly, it relates to a developing apparatus including a developer containing container having an agitating member therein.

Here, an electrophotographic image forming apparatus serves to form an image on a recording medium by using an electrophotographic image forming process, and as examples of the electrophotographic image forming apparatus, for example, there are an electrophotographic copying machine, an electrophotographic printer (for example, laser beam printer, LED printer and the like), an electrophotographic facsimile apparatus, electrophotographic word processor and the like.

Further, a process cartridge may incorporate electrifying means, developing means or cleaning means, and an electrophotographic photosensitive member as a cartridge unit which is detachably attachable to a main body of an image forming apparatus or may incorporate at least one of electrifying means, developing means and cleaning means, and an electrophotographic photosensitive member as a cartridge unit which is detachably attachable to main body of an image forming apparatus or may incorporate at least developing means, and an electrophotographic photosensitive member as a cartridge unit which is detachably attachable to a main body of an image forming apparatus. Incidentally, the present invention also relates to an process cartridge including developing means.

2. Related Background Art

Conventionally, in connection with an image forming apparatus using an electrophotographic image forming process, there has been proposed a process cartridge system in which an electrophotographic photosensitive member and process means acting on the electrophotographic photosensitive member are integrally incorporated as a cartridge unit which is detachably attachable to a main body of an image forming apparatus. According to such a process cartridge system, since the maintenance of the apparatus can be performed by an operator himself without any expert, the operability can be improved considerably. Thus, the process cartridge system has widely been used in image forming apparatuses.

In such a process cartridge, a bearing member attached to a developing apparatus is provided with a seal member for preventing leakage of toner.

For example, there are bearings disclosed in Japanese Patent Laid-Open Application No. 11-133738 (FIG. 8) and Japanese Patent Laid-Open Application No. 11-102107 (FIG. 7).

However, there is no idea that these bearings can easily be disassembled to facilitate the maintenance or to facilitate the recycle of the bearings.

SUMMARY OF THE INVENTION

The present invention is made in consideration of the above-mentioned conventional circumstances, and an object of the present invention is to provide a developing apparatus having a bearing which can easily be disassembled.

Another object of the present invention is to provide a developing apparatus comprising a developer containing container, an agitating member for agitating developer contained in the developer containing container, a drive transmitting member for transmitting a power to the agitating member by engaging a rotary shaft of the agitating member, and a bearing adapted to rotatably hold the drive transmitting member and attached to the developer containing container, and wherein the bearing has dislodgment preventing means with respect to the developer containing container.

The other objects and features of the present invention will be more apparent from the following detailed explanation of the invention referring to the accompanying drawings.

DETAILED DESCRIPTION OF THE PREFERRED EMBODIMENTS

The present invention will now be explained in connection with embodiments thereof with reference to the accompanying drawings.

In the following description, a term "longitudinal direction" means a direction transverse to a conveying direction of a recording medium and parallel with the recording medium. Further, a term "upper" of a process cartridge means an upper side of the process cartridge in a mounting condition.

Figure 1:
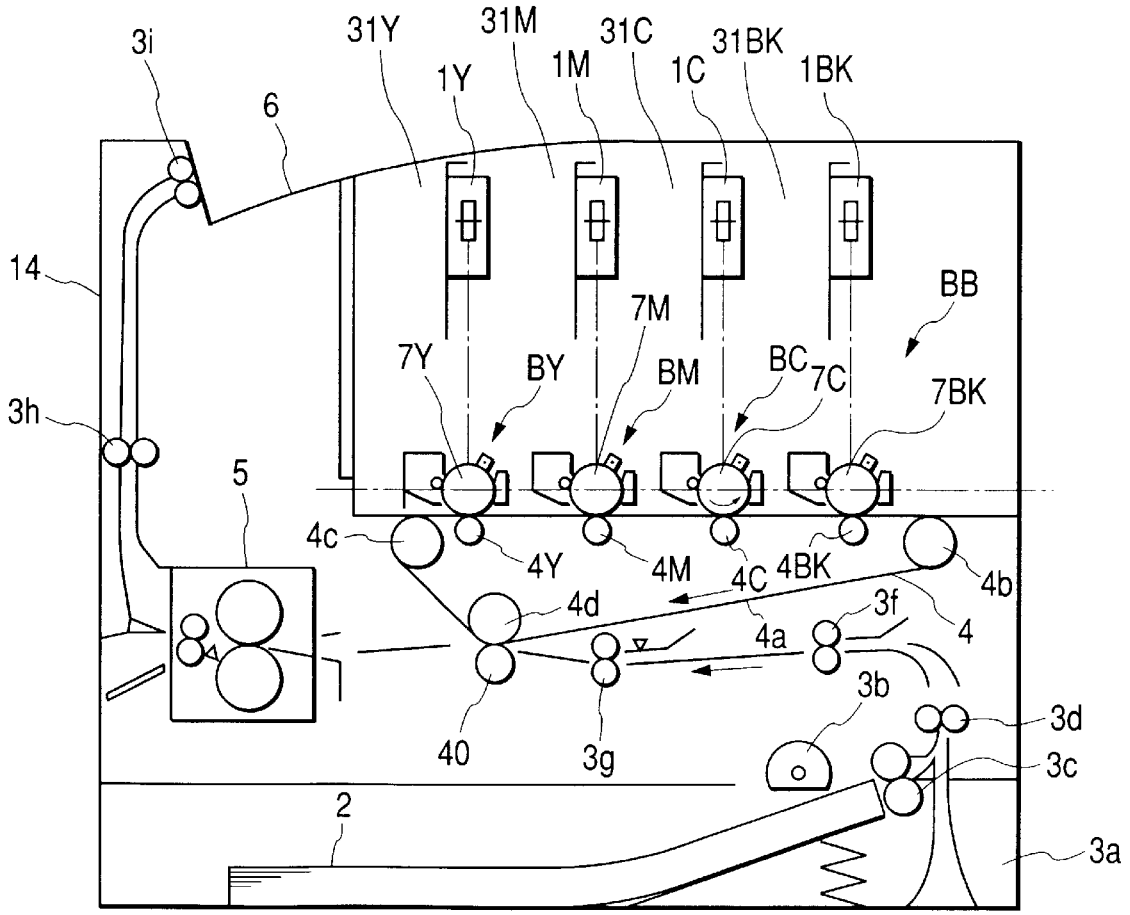
FIG. 1 is a longitudinal sectional view of an electrophotographic image forming apparatus.

FIG. 1 is a view showing an image forming apparatus to which the present invention is applied. The image forming apparatus includes image forming portions 31Y, 31M, 31C and 31BK for forming toner images on photosensitive drums as image bearing members, an intermediate transfer belt 4*a* to which the toner images are temporarily transferred, a secondary transfer roller 40 as transferring means for transferring the toner images on the belt 4*a* onto a recording medium 2, sheet feeding means for feeding out the recording medium 2 between the intermediate transfer belt 4*a* and the secondary transfer roller 40, sheet conveying means for conveying the recording medium to the transferring means, fixing means, and sheet discharging means.

Now, image formation will be described.

As shown, a sheet feeding cassette 3*a* for stacking and containing a plurality of recording media 2 (for example, recording papers, OHP sheets, cloths or the like) is detachably mounted to the image forming apparatus. The recording media 2 picked up from the sheet feeding cassette 3*a* by means of a pick-up roller 3*b* are separated one by one by means of a pair of retard rollers 3*c*, and the separated recording medium is conveyed to a registration roller pair 3*g* by pairs of conveying rollers 3*d*, 3*f*.

When the recording medium 2 is conveyed, the registration roller pair 3*g* is stopped, so that, by abutting the recording medium against a nip of the registration roller pair, skew-feed of the recording medium 2 is corrected.

In case of a four-drum full-color system, as shown, four process cartridges BY, BM, BC, BB including image bearing members for yellow, magenta, cyan and black colors are juxtaposed. Optical scanning systems 1Y, 1M, 1C, 1BK are associated with the respective process cartridges BY, BM, BC, BB, so that, after respective color toner images are formed on the photosensitive drums in response to image signals, the toner images are successively transferred onto the intermediate transfer belt 4*a* (running in a direction shown by the arrow) in a superimposed fashion by means of transfer rollers 4 (4Y, 4M, 4C, 4BK).

Thereafter, the recording medium 2 is sent out to the secondary transfer roller 40 at a predetermined timing, and the toner images on the intermediate transfer belt 4*a* are collectively transferred onto the recording medium 2. After the toner images are fixed to the recording medium by means of a fixing device 5, the recording medium is discharged onto a tray 6 on a main body 14 of the apparatus via pairs of discharge rollers 3*h*, 2*i*.

The image forming portions 31Y, 31M, 31C and 31BK constitute the process cartridges BY, BM, BC, BB, respectively, except for the optical scanning systems 1Y, 1M, 1C, 1BK. Since constructions of the process cartridges are identical, only the process cartridge BY will be described.

Figure 2:
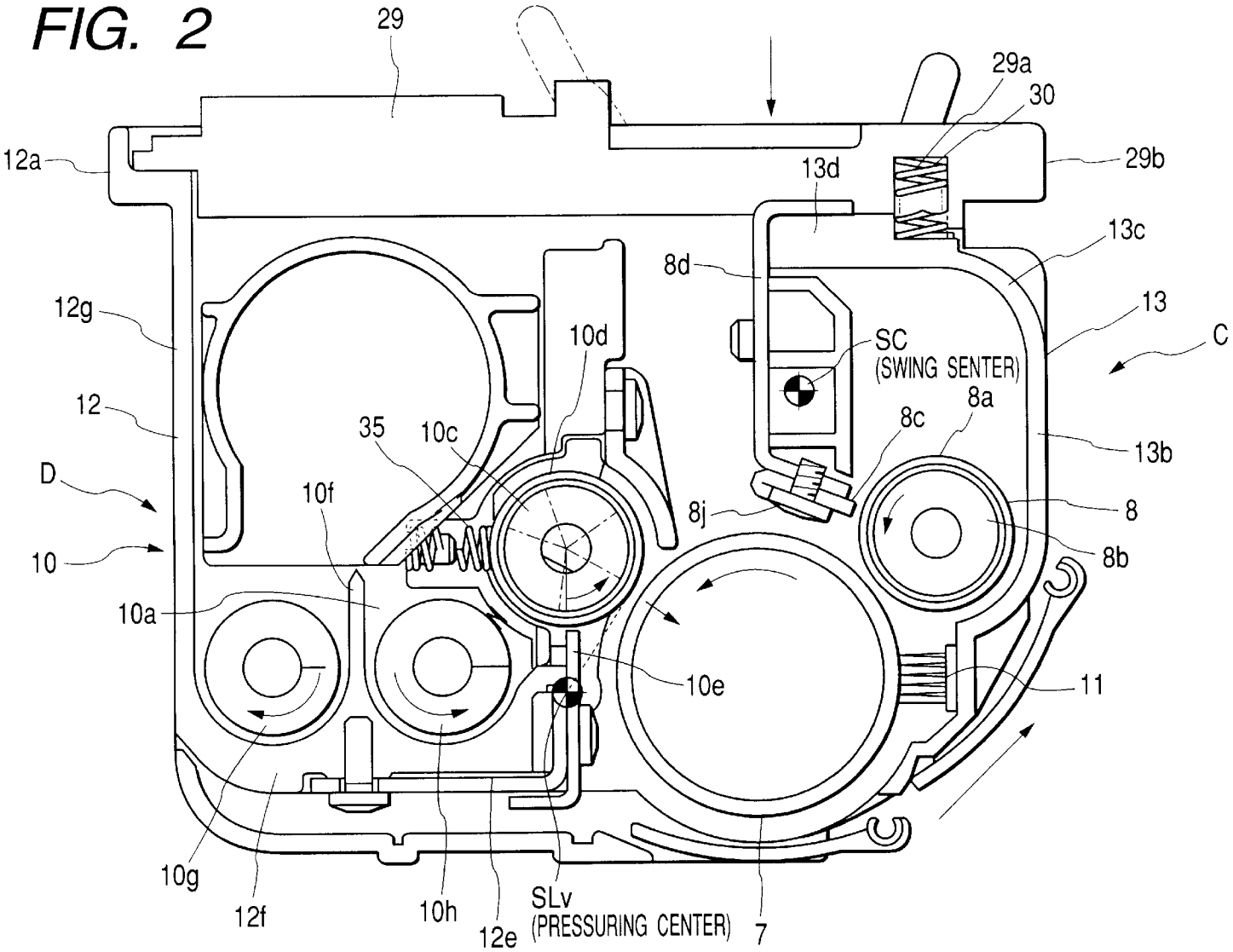
FIG. 2 is a longitudinal sectional view of a process cartridge.

As shown in FIG. 2, in the process cartridge BY, electrifying means, an exposure portion, developing means and a transfer opening are arranged around a photosensitive drum 7. In the illustrated embodiment, two-component developer including magnetic carrier powder is used. Thus, in the illustrated embodiment, although a usually used organic photosensitive member can be used as the photosensitive drum 7, desirably, when a photosensitive member in which a surface layer made of material having resistance of $10^2$ to $10^{14}$ Ω·cm is provided on the organic photosensitive member or an amorphous silicon photosensitive member is used, charge injection electrifying can be realized, thereby preventing generation of ozone and reducing power consumption. Further, the electrifying ability can be improved.

Thus, in the illustrated embodiment, a photosensitive drum 7 in which a negatively charged organic photosensitive member is provided on a drum substrate made of aluminium was used.

The electrifying means comprises a magnet brush electrifier 8 using magnetic carrier.

In the electrifier 8, a fixed magnet 8*b* is disposed within a hollow cylindrical electrifying roller 8*a* rotatably supported. After the transferring, residual toner remaining on the photosensitive drum 7 is picked up by the electrifier 8 rotated in a direction shown by the arrow.

In the illustrated embodiment, as the developing means, a system for effecting developing with two-component developer in a contacted condition (two-component contacting developing) is used.

FIG. 2 shows two-component magnet brush developing means 10 used in the illustrated embodiment. A developing sleeve 10*d* is a hollow cylinder rotatably supported. A fixed magnet 10*c* is disposed within the developing sleeve 10*d*. The developing sleeve 10*d* is rotated in the same direction as the photosensitive drum 7 so that a peripheral surface is shifted in a direction opposite to a shifting direction of a peripheral surface of the photosensitive drum 7. The photosensitive drum 7 is not contacted with the developing sleeve 10*d* to define a gap of about 0.2 to 1.0 mm therebetween, so that the developing is effected in a condition that the developer is contacted with the photosensitive drum 7.

The toner mixed with the carrier is supplied by agitating screws 10*g*, 10*h* disposed within a casing partitioned by a longitudinal partition wall 10*f* except for both ends. The toner supplied from a toner supplying container (not shown) is dropped onto one end of the agitating screw log and is agitating while being sent toward one longitudinal direction and then is passed through an opening of the partition wall 10*f* at the other end and then is shifted toward one end by the agitating screw 10*h* and then is passed through an opening of the partition wall 10*f* at said one end and thus is agitated by the agitating screw 10*h* while being sent. In this way, the toner is circulated.

Now, a developing process for visualizing an electrostatic latent image formed on the photosensitive drum 7 by means of a two-component magnet brush method using the developing apparatus 10 and a developer circulating system will be explained. First of all, while the developer is being carried, the developer is regulated by a regulating blade, i.e., developing blade 10*e* disposed perpendicular to the developing sleeve 10*d*, thereby forming a thin developer layer on the developing sleeve 10*d*. When the thin developer layer is carried to a main developing pole, developer chains are formed by a magnetic force. The electrostatic latent image formed on the photosensitive drum 7 is developed by the developer chains, and, thereafter, the developer on the developing sleeve 10*d* is returned to a developing container 10*a* by a repelling magnetic field.

DC voltage and AC voltage are applied to the developing sleeve 10*d* from a power supply (not shown). In general, in the two-component developing method, when the AC voltage is applied, although developing efficiency is increased and a high quality image can be obtained, fog is apt to occur. Thus, normally, by providing potential difference between the CD voltage applied to the developing sleeve 10*d* and surface potential of the photosensitive drum 7, during the developing, the toner is prevented from adhering to nonimage area.

The toner images are then transferred onto the intermediate transfer belt 4*a* by an intermediate transferring device 4. In the intermediate transferring device 4, the endless belt 4*a* is wound around a driving roller 4*b,* a driven roller 4 and a secondary transfer counter roller 4*d* to be turned in a direction shown by the arrow in FIG. 1. Further, within the inside of the transfer belt 4*a*, there are provided transfer electrifying rollers 4Y, 4M, 4C and 4BK, which transfer electrifying rollers generate pressurizing forces directing toward the photosensitive drums 7 from the inside of the belt 4*a*. Meanwhile, by applying voltage to the transfer electrifying rollers from high voltage sources to effect electrifying having polarity opposite to that of the toner from the back side of the belt 4*a*, the toner images on the photosensitive drums 7 are successively transferred onto the front surface of the intermediate transfer belt 4*a*.

The intermediate transfer belt 4*a* can be made of polyimide resin. The material of the belt 4*a* is not limited to the polyimide resin, but, for example, dielectric plastic material such as polycarbonate resin, polyethylene telephalate resin, polychlorovinylidene resin, polyethylene naphthalate resin, polyether ether ketone resin, polyether sulfone resin or polyurethane resin, fluororubber or silicone rubber can suitably be used.

After the toner image is transferred, transfer-residual toner is remaining on the photosensitive drum 7. If such residual toner is passed through the electrifier as it is, electrifying potential of only a remaining image portion will be reduced or a pre-image portion in a next image will become thinner or denser (referred to as "ghost phenomenon" hereinafter). Even after the residual toner is passed below the electrifying magnet brush contacted with the photosensitive drum 7, in almost causes, the shape of the pre-image is remained as it is. Thus, as the photosensitive drum 7 is rotated, the residual toner reached to the electrifying area must be removed by the magnet brush electrifier 8 to erase history of the pre-image. Here, although the residual toner remaining on the photosensitive drum 7 often includes positively charged particles and negatively charged particles due to peel discharging in the transferring, it is desirable that the residual toner is positively charged to facilitate the collection of the toner into the magnet brush electrifier 8.

In the illustrated embodiment, a conductive brush 11 is contacted with the photosensitive drum 7 between the intermediate transferring device 4 and the magnet brush electrifier 8 and bias having polarity opposite to the electrifying bias is applied to the brush. The positively charged residual toner is passed through the magnet brush electrifier 8; whereas, the negatively charged residual toner is temporarily caught by the conductive brush 11, and, after electricity is removed, it is returned again onto the photosensitive drum 7. In this way, the residual toner is apt to be collected toward the magnet brush.

(Construction of frame of process cartridge)

In the process cartridge B (BY, BM, BC, BB), an electrifying unit C in which the electrifying roller 8*a,* regulating blade 8*c* and electrifying brush 11 are incorporated via an electrifying frame 13 is assembled to a developing unit D in which the electrophotographic photosensitive drum 7 and developing means 10 are incorporated via a developing frame 12. Further, the developing unit D and electrifying unit C are positioned and joined at both longitudinal ends by a front cover 16 and a rear cover 17 (FIG. 4).

Figure 3:
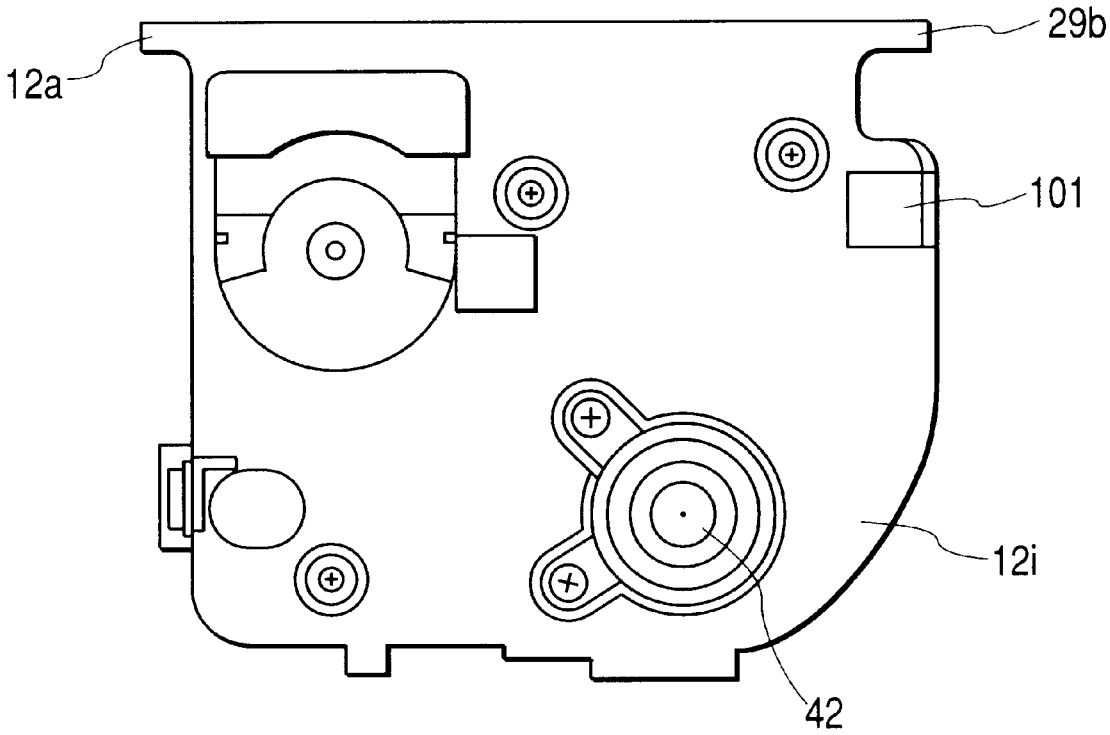
FIG. 3 is a front view of the process cartridge.
Figure 4:
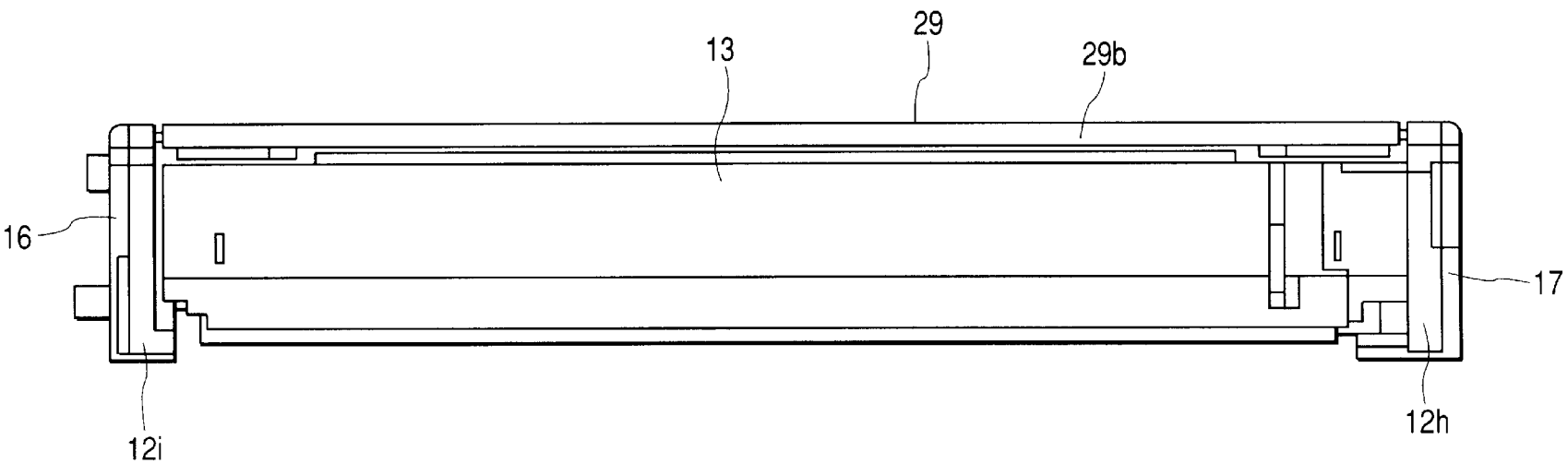
FIG. 4 is a right side view of the process cartridge.
Figure 5:
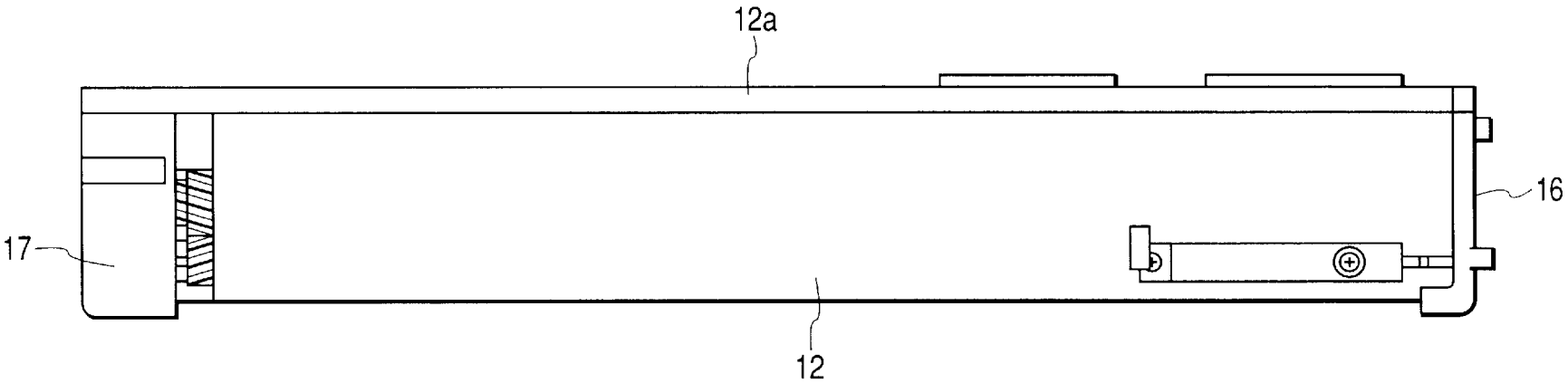
FIG. 5 is a left side view of the process cartridge.
Figure 6:
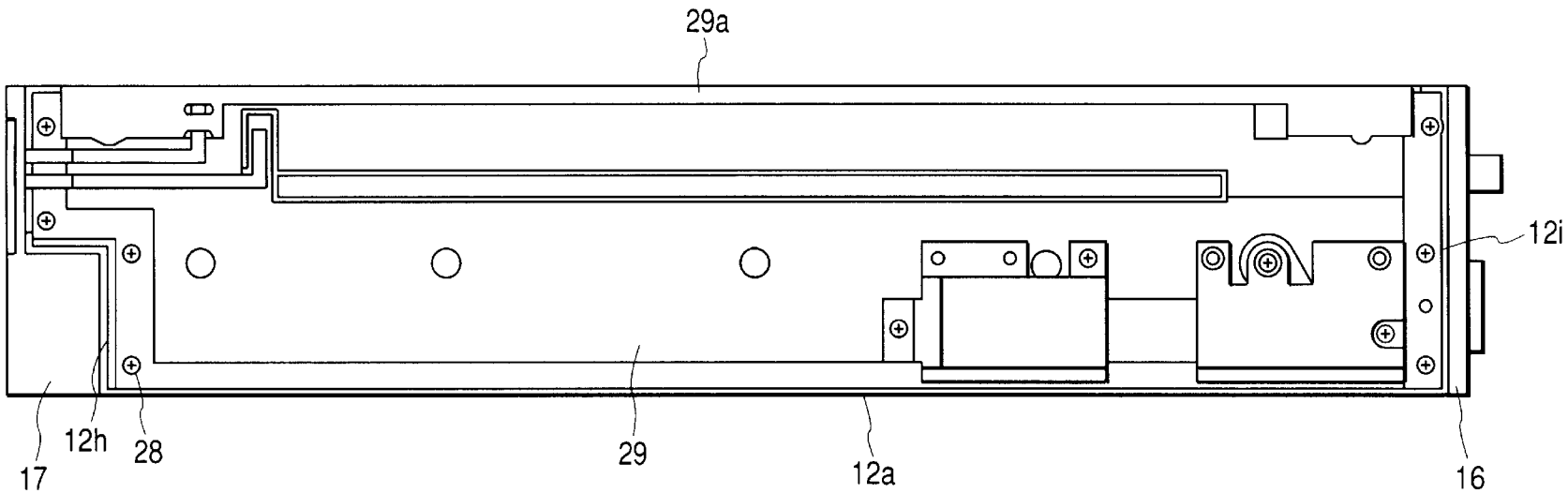
FIG. 6 is a plan view of the process cartridge.
Figure 7:
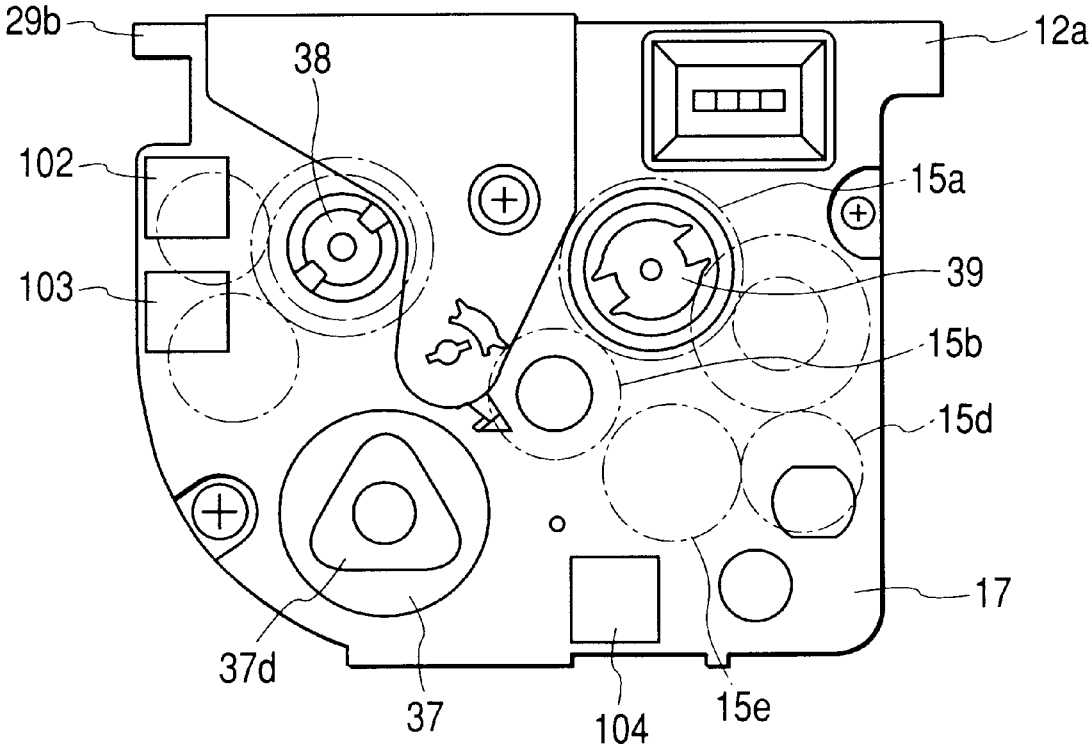
FIG. 7 is a back view of the process cartridge.
Figure 8:
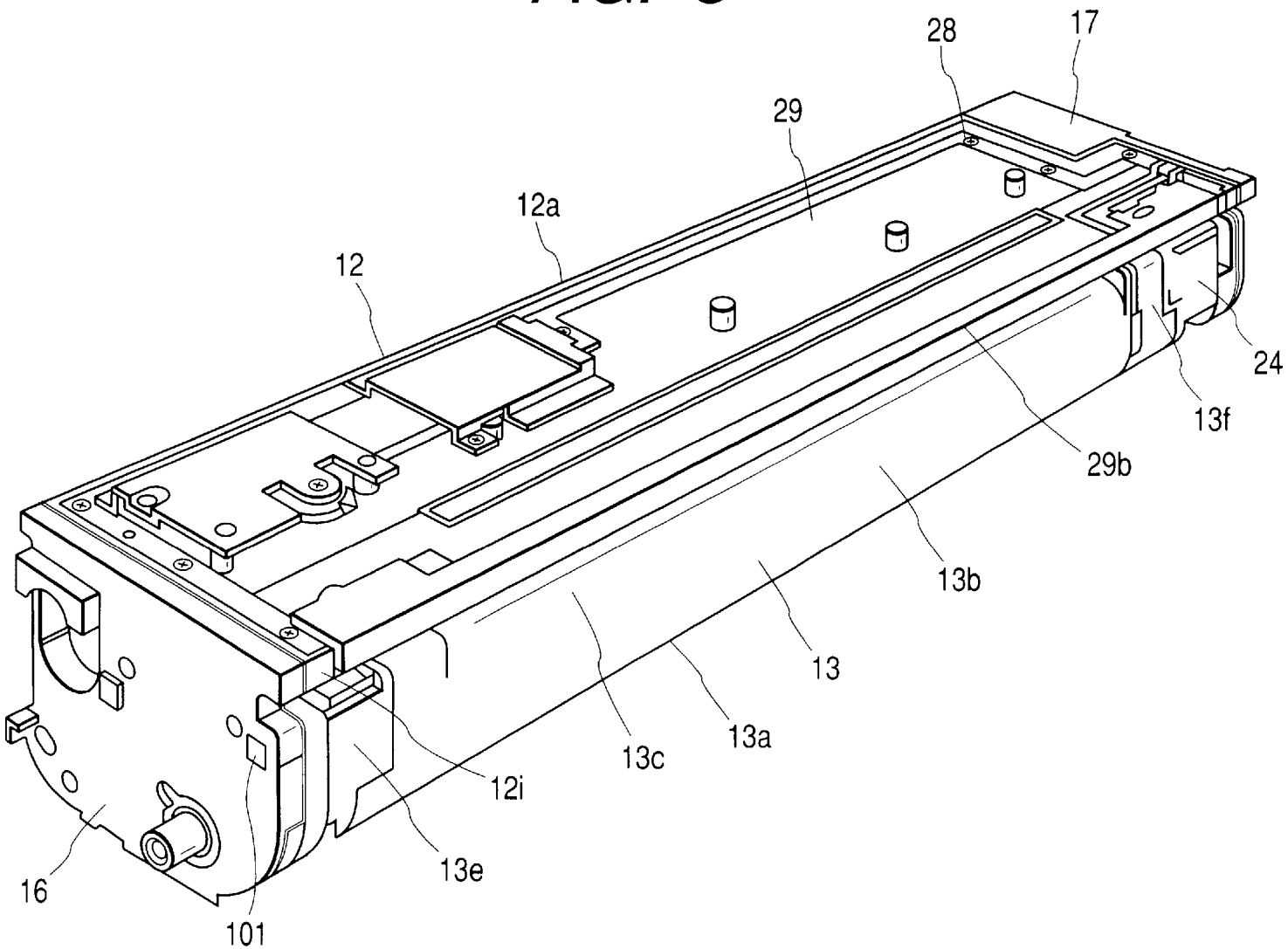
FIG. 8 is a front perspective view of the process cartridge, looked at from the right.
Figure 9:
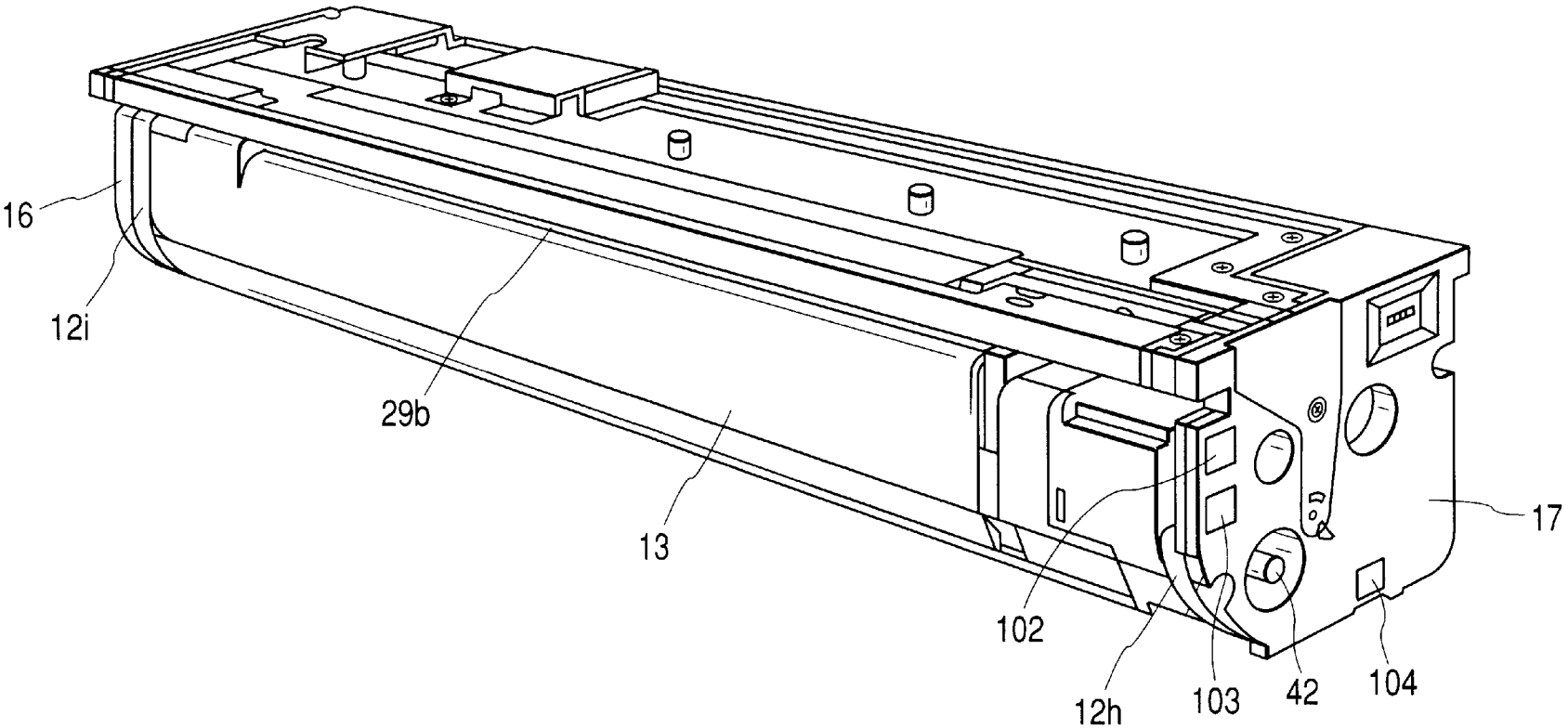
FIG. 9 is a rear perspective view of the process cartridge, looked at from the left.
Figure 10:
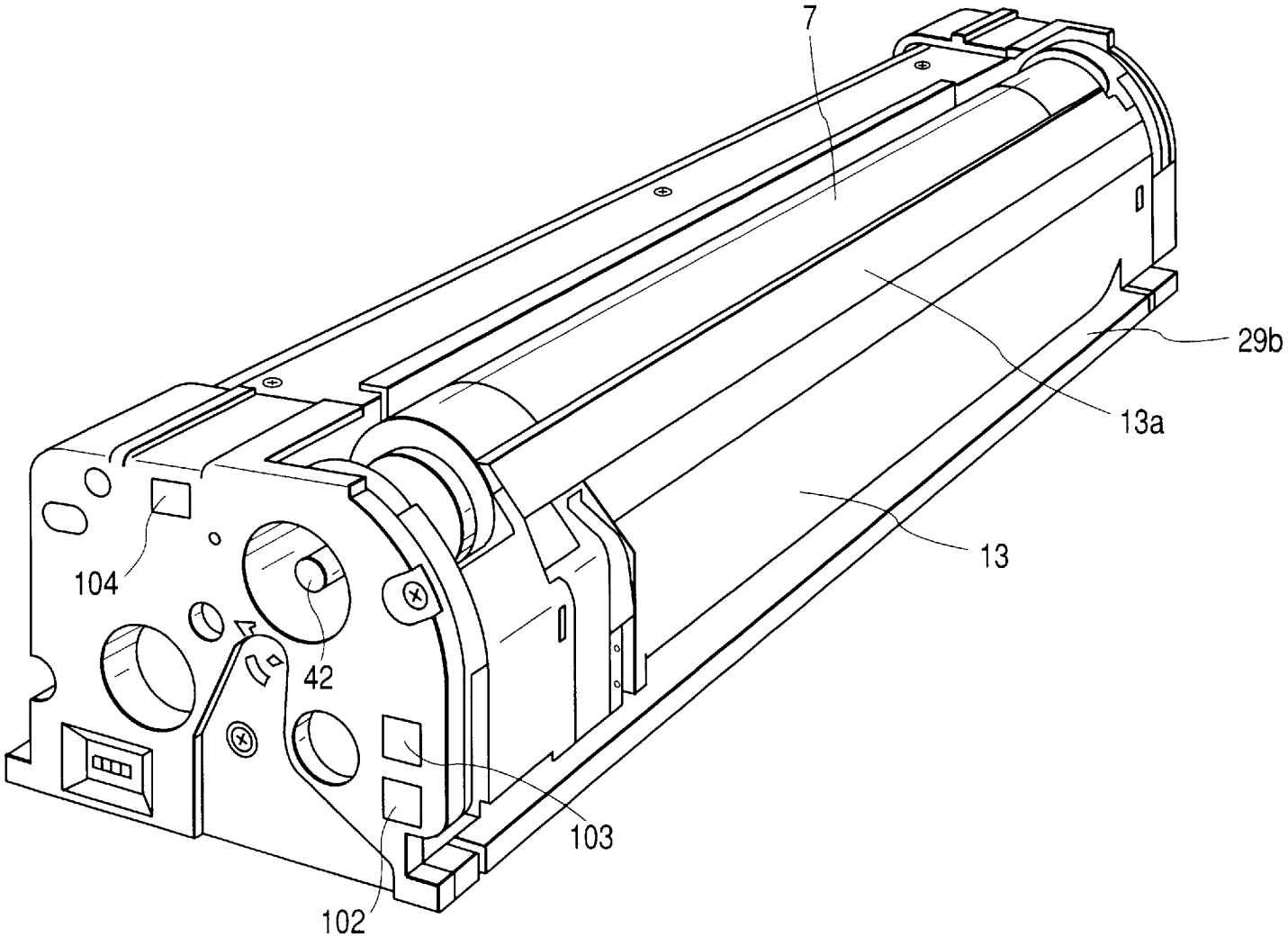
FIG. 10 is a perspective view of the process cartridge in a reverse condition, looked at from an oblique rear side.

FIGS. 3 to 7 show the process cartridge B (BY, BM, BC, BB), where FIG. 3 is a front view, FIG. 4 is a right side view, FIG. 5 is a left side view, FIG. 6 is a plan view and FIG. 7 is a back view. FIGS. 8 to 10 are perspective view of the process cartridge B, where FIG. 8 is a perspective view looked at from a front oblique direction, FIG. 9 is a perspective view looked at from a rear oblique direction, and FIG. 10 is a perspective view looked at from a rear oblique direction, with a bottom surface reversed to face upwardly.

As shown in FIG. 2, in the electrifying unit C, the electrifying roller 8*a,* regulating blade 8*c* and conductive brush 11 are integrated by the electrifying frame 13. As shown in FIGS. 2, 4, 8, 9 and 10, the electrifying frame 13 forms a part of an outer frame of the process cartridge B. As shown in FIGS. 2 and 10, a lower edge 13*a* of the electrifying frame 13 is disposed closely adjacent to the photosensitive drum 7 to define a gap therebetween and in parallel with the photosensitive drum 7. A vertical wall 13*b* constituting a part of the outer frame of the process cartridge B extends from the lower edge 13*a* substantially vertically and is curved at an upper part to define a corner 13*c*. A top plate portion 13*d* extends from the corner 13*c* substantially horizontally and has a substantially key-shaped cross-section, and, a space is defined below the top plate portion 13*d,* and member attaching portions 13*e,* 13*f* (FIG. 8) are integrally formed with the vertical wall 13*b* at both longitudinal ends.

Figure 11:
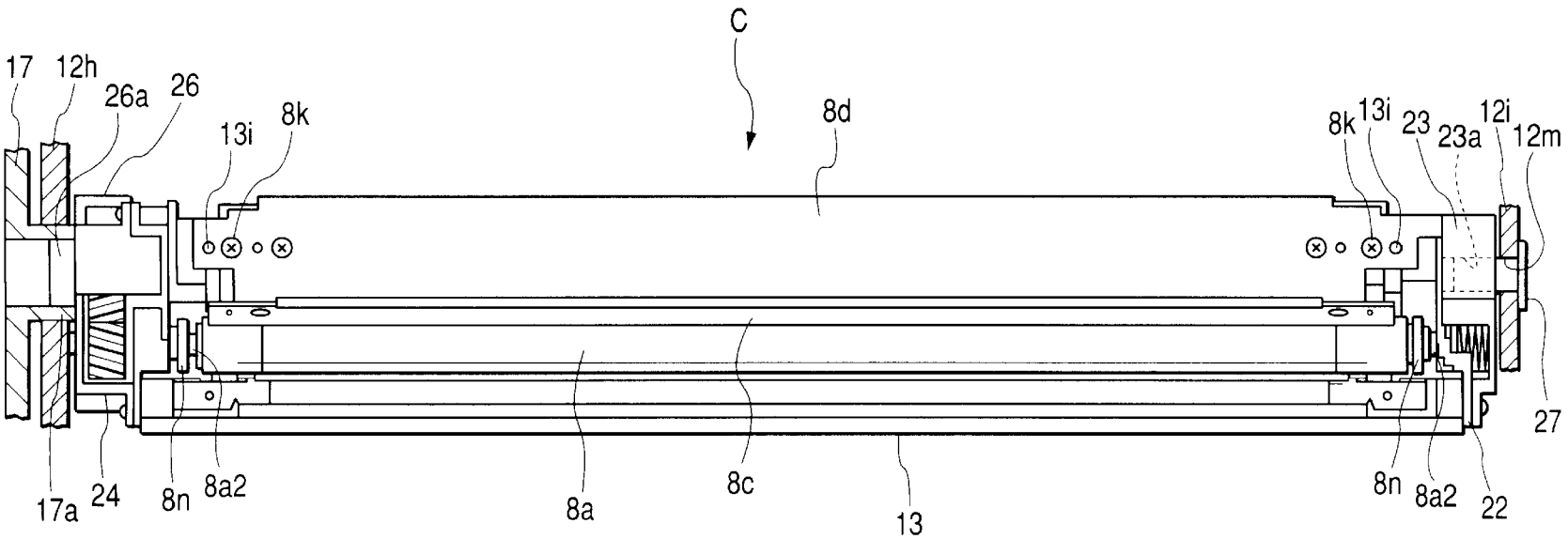
FIG. 11 is a front view of an electrifying unit.

FIG. 11 is a side view looked at from the interior of the electrifying unit C. At a front side one end of the electrifying unit 13 in a mounting direction of the process cartridge B (the process cartridge is mounted to the main body 14 from a front side in the longitudinal direction), an electrifying roller bearing 22 and an end cover 24 are secured by screws. Further, a gear unit 24 is secured to the other end by screws.

Figure 12:
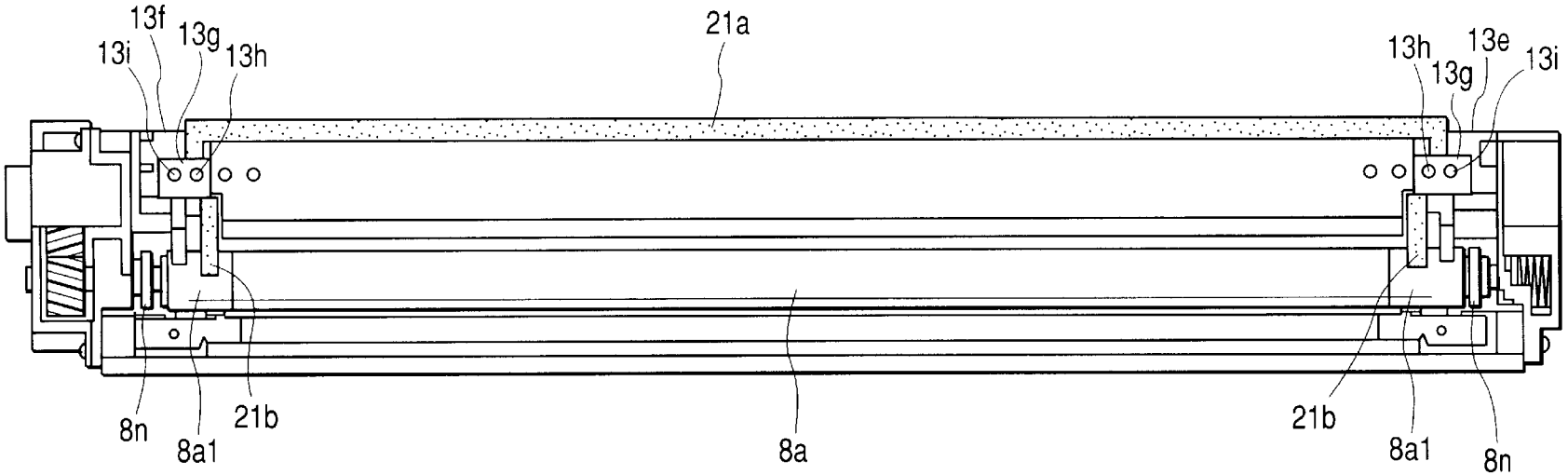
FIG. 12 is a front view of the electrifying unit of FIG. 11, with a blade omitted.

FIG. 12 is a side view of the electrifying unit C with regulating blade 8*c* and support metal plate 8*d* omitted. As shown in FIG. 12, each blade attachement seat portions 13*g* raised from the member attachement portions 13*e,* 13*f* via steps is provided with a female threaded portion 13*h* and a dowel 13*i* in a surface contacted with the regulating blade 8*c*. A longitudinal seal member 21*a* such as sponge is adhered to a surface retarded from the seat portions 13*g*. Further, seal members 21*b* such as felt for preventing the developer from leaking axially outwardly are adhered to seal portions 8*a*1 at both ends of the electrifying roller 8*a* along a circumferential direction. Accordingly, portions of the electrifying frame 13 opposed to the seal portions 8*a*1 at both ends of the electrifying roller 8*a* are arcuate surfaces coaxial with the electrifying roller 8*a*.

As shown in FIG. 2, the metallic regulating blade 8*c* is spaced apart from the electrifying roller 8*a* and is secured to the support metal plate 8*d* by small screws 8*j*. The support metal plate 8*d* has a groove-shaped section and is fitted onto the dowels 13*i* of the seat portions 13*g* of the electrifying frame 13. Further, the support metal plate 8*d* abuts against the seat portions 13*g* by threading small screws 8*k* into the female threaded portions 13*h* of the seat portions 13*g* through holes formed in the support metal plate 8*d* and the seal member 21*a* is compressed by the support metal plate 8*d*. Further, the seal members 21*b* near the seat portions 13*g* are compressed by the support metal plate 8*d*. The support metal plate 8*d* has very high rigidity, and the electrifying frame 13 is reinforced by securing the support metal plate to the electrifying frame 13.

(Mounting of electrifying unit)

The electrifying unit C is supported by the developing frame 12 for swinging movement around a swing center SC shown in FIG. 2. To this end, as shown in FIG. 11, a gear case 26 of a gear unit 24 secured to a longitudinal rear side of the electrifying frame 13 is provided with a cylindrical shaft portion 26*a* centered on the swing center SC, and an end cover 23 at the other longitudinal end is provided with a hole 23*a* centered on the swing center SC.

Figure 13:
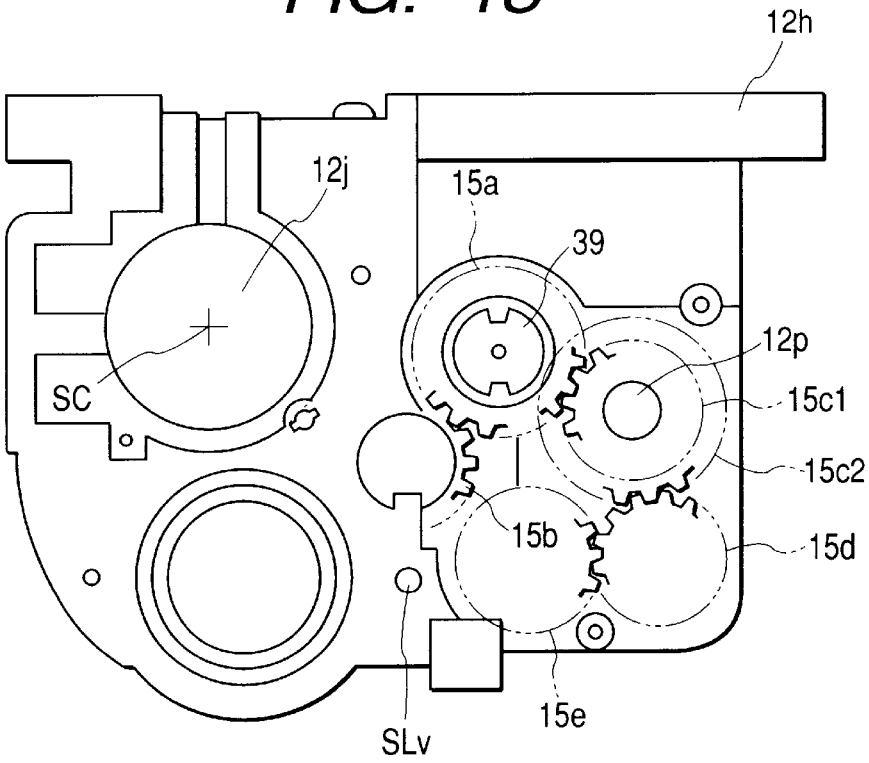
FIG. 13 is a back view of a developing unit, with a rear cover omitted.
Figure 14:
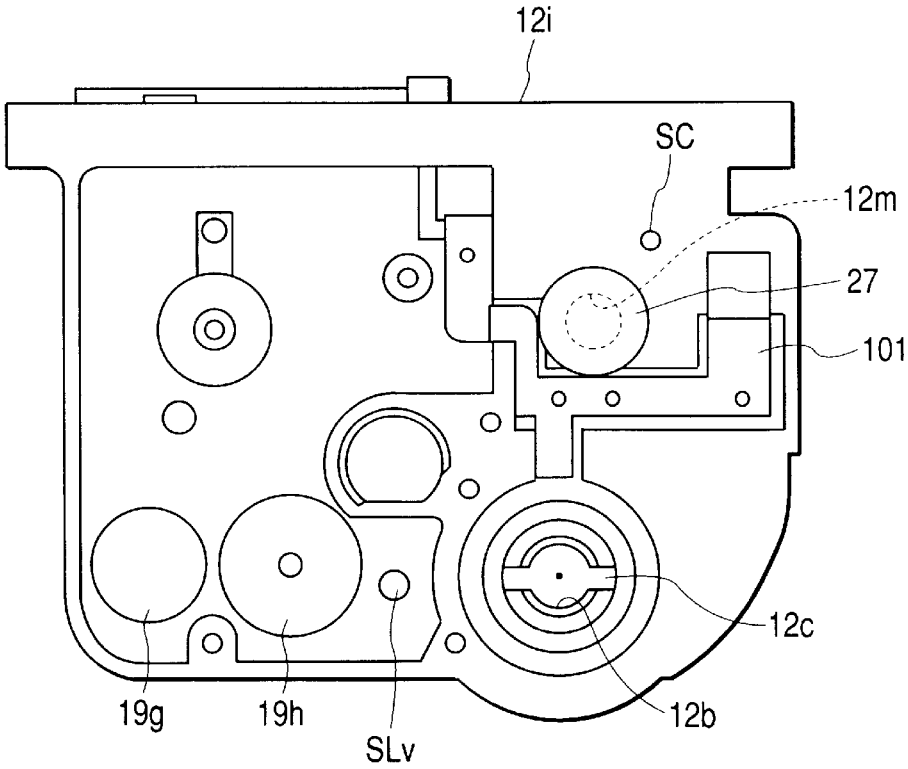
FIG. 14 is a front view of the developing unit, with a front cover omitted.
Figure 15:
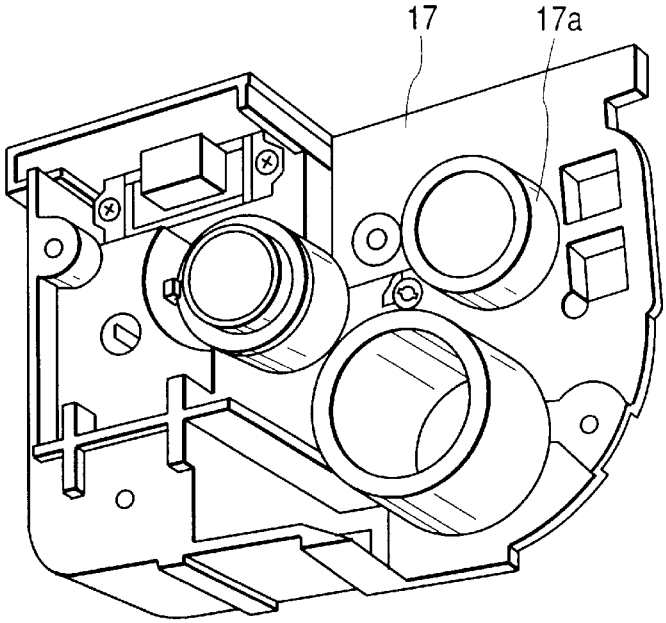
FIG. 15 is a perspective view illustrating interior of the rear cover.
Figure 16:
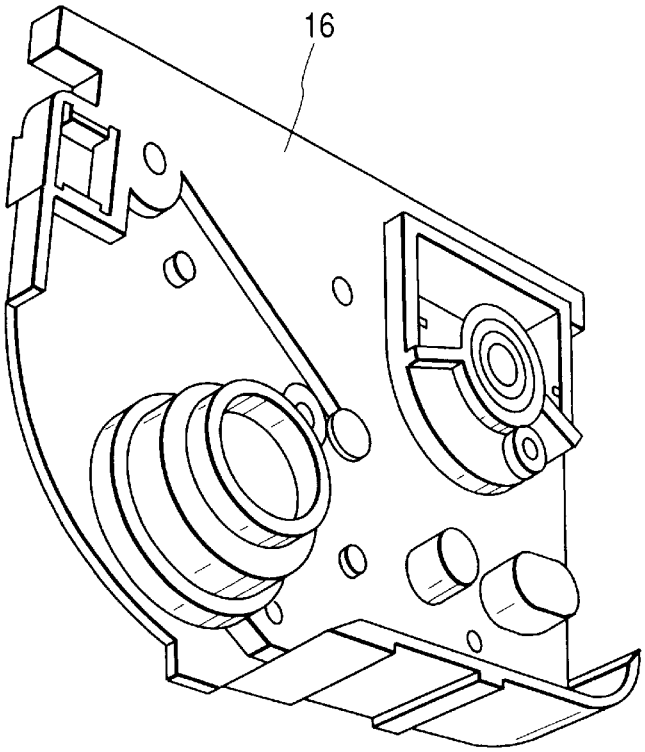
FIG. 16 is a perspective view illustrating interior of the front cover.
Figure 17:
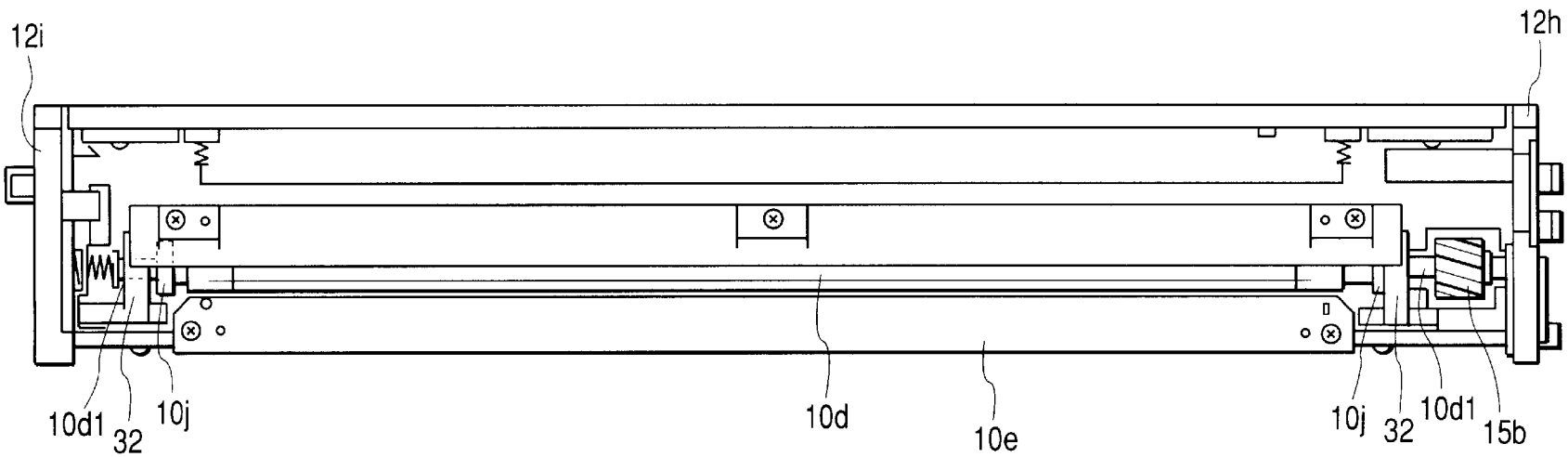
FIG. 17 is a side view of the developing unit.

As shown in FIG. 2, the developing frame 12 has a lower portion 12*f* adapted to contain the agitating screws 10*g*, 10*h* at both sides of the partition wall 10*f* and having a seat portion 12*e* to which the regulating blade 10*e* is attached, a side portion 12*g* forming a left side outer frame of the process cartridge B looked at from the mounting direction, and end plate portions 12*h* (that side) and 12*i* (this side) on both longitudinal ends as shown in FIGS. 13, 14 and 17. One end plate portion 12*h* is provided with a hole 12*j* for rotatably supporting the cylindrical shaft portion 26*a* of the electrifying unit C via a bearing. The other end plate portion 12*i* is provided with a hole 12*m* having the same diameter as that of the 23*a* of the electrifying frame 13. In a condition that the cylindrical shaft portion 26*a* of the electrifying unit C is inserted into the hole 12*j* of the end plate portion 12*h* of the developing frame 12, the cylindrical fitting hole 23 of the electrifying unit C is aligned with the hole 12*m* of the end plate portion 12*i* of the developing frame 12. When the rear cover 17 at that side looked at from the mounting direction of the process cartridge B is aligned to coincide with the end of the developing frame 13, an outer periphery of a hollow cylindrical shaft support portion 17*a* (FIGS. 11 and 15) protruded in the longitudinal direction in the inside of the rear cover 17 is fitted into the hole 12*j* of the developing frame 12 and at the same time an inner periphery of the shaft support portion is fitted onto the cylindrical shaft portion 26*a* of the electrifying unit C. Further, a support shaft 27 (FIGS. 11 and 14) fitted in the hole 12*m* of the end plate portion 12*i* of the developing frame 12 and protruded therefrom is fitted into the hole 23*a* of the electrifying unit C. In this way, in the electrifying unit C, the cylindrical shaft portion 26*a* is rotatably supported by the end cover 17 at one end and the hole 23*a* is rotatably supported by the developing frame 12 at the other end.

As shown in FIGS. 6 and 8, at an upper part of the developing frame 12, a top plate 29 is secured to the developing frame 12 by small screws 28 while abutting against inside of an upper guide portion 12*a* of the side plate 12*g* and the end plate portions 12*h*, 12*i*.

As shown in FIG. 2, two spring seats 29*a* are provided on the top plate 29 along a longitudinal direction. Compression coil springs 30 held in the spring seats 29*a* are compressed between the top plate 29 and the electrifying frame 13. By spring forces of the springs 30, the electrifying unit C is biased in a clockwise direction in FIG. 2 around the swing center SC.

As shown in FIG. 11, spacer rollers 8*n* are rotatably fitted on reduced diameter journal portions 8*a*2 at both ends of the electrifying roller 8*a*. The spacer rollers 8*a* abut against a nonimage are of the photosensitive drum 7 by the spring force of the compression coil springs 30. With this arrangement, the gap is defined between the photosensitive drum 7 and the electrifying roller 8*a*, so that the residual toner trying to pass through the gap between the electrifying roller 8*a* and the photosensitive drum 7 is caught by shifting the peripheral surface of the electrifying roller 8*a* in the direction opposite to the shifting direction of the peripheral surface of the photosensitive drum 7 and by applying the electrifying bias to the electrifying roller 8*a*.

In the above description, a line connecting between the swing center and a center of the electrifying roller 8*a* is substantially perpendicular to a line connecting between the centers of the electrifying roller 8*a* and of the photosensitive drum 7.

As shown in FIG. 2, the developing sleeve 10*d* is rockably attached to the developing frame 12 for swinging movement around a pressurizing center SLv. As shown in FIG. 17, spacer rollers 10*j* having a radius greater than that of the developing sleeve 10*d* by an amount corresponding to the developing gap are fitted onto reduced diameter journal portions 10*d*1 at both ends of the developing sleeve 10*d*. Swing arms 32 into which the journal portions 10*d*1 are fitted are provided outside of the spacer rollers 10*j*.

Figure 18:
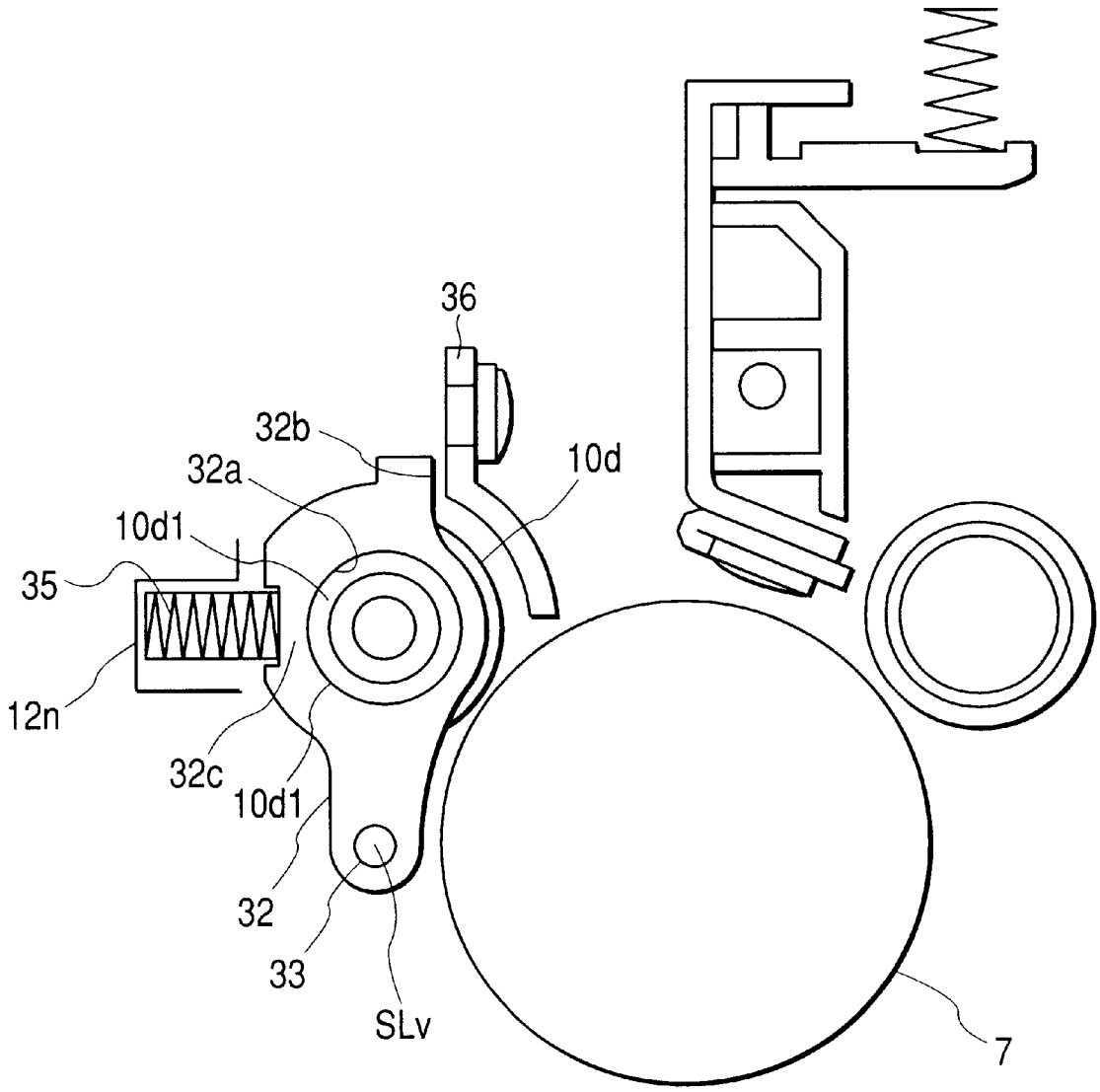
FIG. 18 is a front view showing a support portion for a developing sleeve.

FIG. 18 is a sectional view showing a side surface of the swing arm 32 and therearound in a plane perpendicular to the developing sleeve 10*d*. Proximal ends of the swing arms 32 are rockably supported on support shafts 33 press-fitted in the both end plate portions 12*h*, 12*i* of the developing frame 12 in the longitudinal direction. The swing arm 32 is provided with a bearing hole 32*a* substantially above the support shaft 33 and a stopper portion 32*b* above the bearing hole. A spring seat 32*c* is provided on a line substantially perpendicular to a line connecting between the pressurizing center SLv and a center of the bearing hole 32*a*.

The both end journal portions 10*d*1 of the developing sleeve 10*d* are rotatably supported in the bearing holes 32*a* of the swing arms 32. Compression coil springs 35 are compressed between the spring seats 32*c* and spring seats 12*n* provided on the end plate portions 12*h*, 12*i* of the developing frame 12. With this arrangement, the developing sleeve 10*d* is rotated and pressurized around the pressurizing center SLv toward the photosensitive drum 7, so that the spacer rollers 10*j* abut against the nonimage area of the photosensitive drum 7, thereby maintaining a predetermined gap (0.2 to 1.0 mm) between the developing sleeve 10*d* and the photosensitive drum 7.

During assembling/disassembling, the stopper portions 32*b* abut against a developing sleeve cover 36, thereby preventing the swing arms 32 from rotating outwardly in FIG. 18. Accordingly, in the assembled condition of the process cartridge B, the stoppers 32*b* do not abut against the developing sleeve cover 36. Incidentally, the developing sleeve cover 36 extends between the both side swing arms 32 along the longitudinal direction and is secured to the developing frame 12 by screws.

(Mounting/dismounting construction of process cartridge) with respect to main body of image forming apparatus)

As shown in FIGS. 3 and 7 etc., flange-shaped guide portions 12*a*, 29*b* are provided on an upper part of the process cartridge at left and right looked at from the mounting/dismounting direction, and the guide portions 12*a*, 29*b* are engaged by guide rails (not shown) perpendicular to the plane of FIG. 1 during mounting and dismounting of the process cartridge with respect to the main body 14 of the image forming apparatus.

When the process cartridge B is mounted to the main body 14 of the image forming apparatus, contacts provided on the process cartridge are connected to contacts of the main body communicated with a high voltage power supply (not shown) provided on to the main body 14 of the image forming apparatus.

As shown in FIGS. 3 and 8, a drum grounding contact 101 communicated with the photosensitive drum 7 is provided at this side looked at from the mounting direction of the process cartridge B. Further, as shown in FIGS. 7, 9 and 10, a conductive brush contact 102 communicated with the conductive brush 11, an electrifying bias contact 103 communicated with the electrifying roller 8*a* and a developing bias contact 104 communicated with the developing sleeve 10*d* are provided at that side looked at from the mounting direction of the process cartridge B.

Three driving force receiving portions as shaft couplings rotated around a longitudinal shaft are provided on an end face at that side looked at from the mounting direction of the process cartridge B. When the process cartridge B is mounted to the main body 14 of the apparatus, the three driving force receiving portions are connected to driving members of the main body 14 of the apparatus.

As shown in FIG. 7, a coupling convex portion 37*d,* an electrifying portion coupling 38 and a developing portion coupling 39 as drum couplings are faced outwardly and located at positions retarded from the end face at that side of the process cartridge B.

Figure 19:
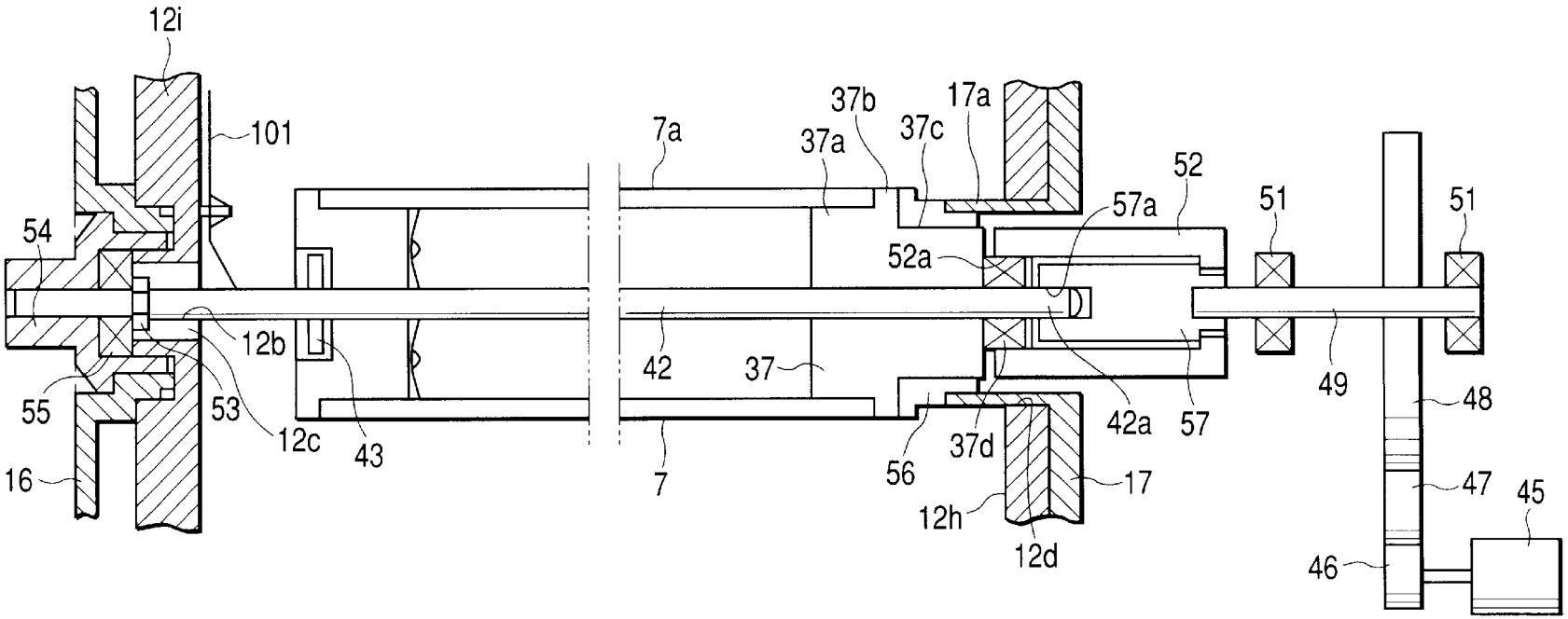
FIG. 19 is a longitudinal sectional view showing support for an electrophotographic photosensitive drum and a driving device.

As shown in FIG. 19, one end of the drum grounding contact 101 attached to the end plate portion 12*i* of the developing frame 12 is elastically contacted with a drum shaft 42. The drum grounding contact 101 is provided on the developing frame 12 and has the other end protruded from the process cartridge B to form an external contact.

In the assembling, a pin 43 can axially pass through a groove 12*c* provided radially from a drum shaft support hole 12*b* of the end plate portion 12*i.*

A driving side drum flange 37 is provided with, in order in an axial direction, an attachment portion 37*a* fitted into a drum cylinder 7*a,* a flange 37*b* contacted with an end of the drum cylinder 37*a,* a journal portion 37*c* having a diameter smaller than that of the flange 37*b,* and a coupling convex portion 37*d* convex axially from an end face center of the journal portion 37*c*. The driving side drum flange 37 is a plastic one-piece formed by molding.

The journal portion 37*c* is rotatably fitted onto a shaft support portion 17*a* integrally formed with the rear cover 17 and fitted into the hole 12*d* of the end plate portion 12*h* of the developing frame 12 via a collar 56.

Figure 20:
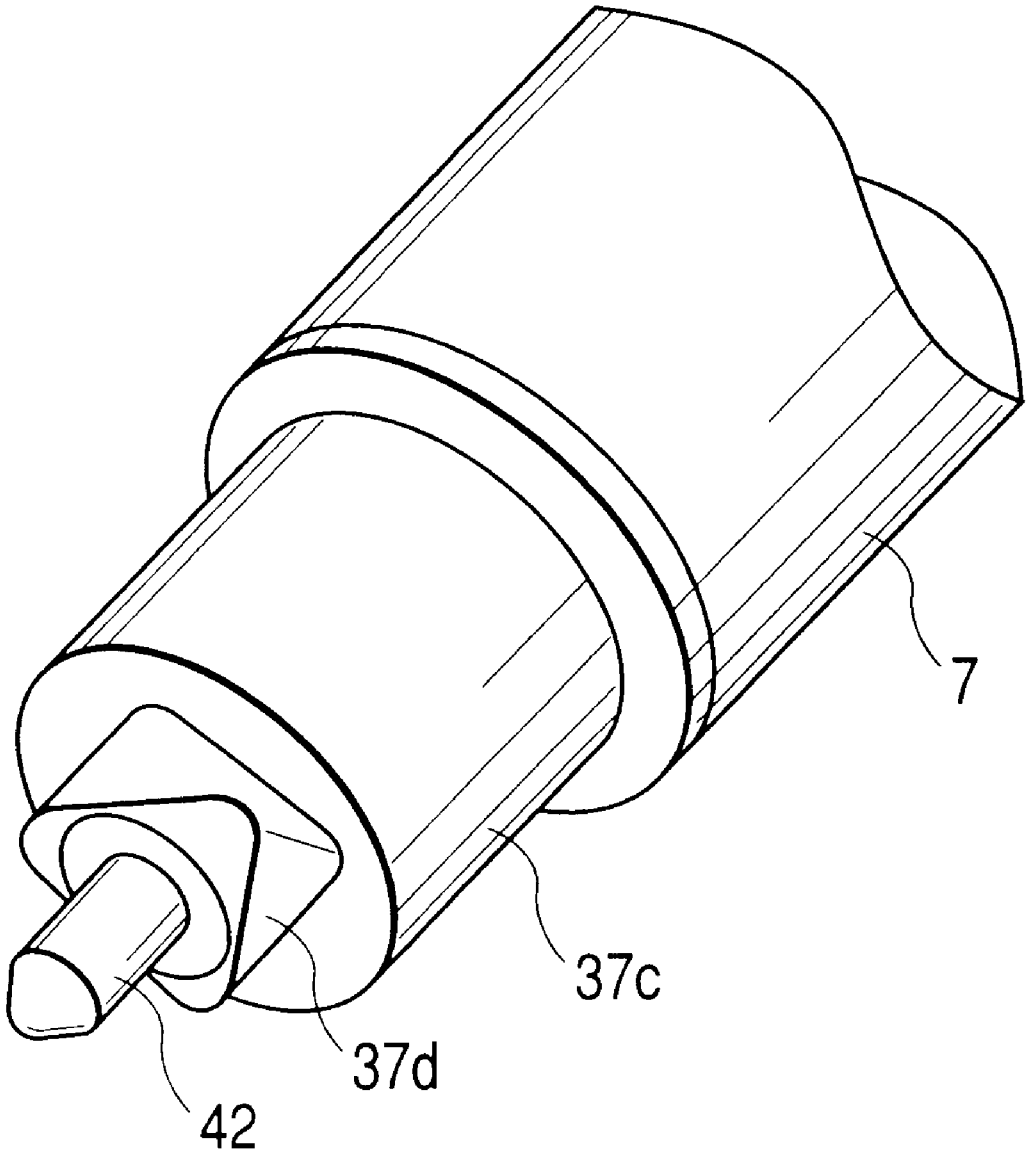
FIG. 20 is a perspective view of a driving side drum flange.

As shown in FIG. 20, the coupling convex portion 37*d* is a twisted regular triangular prism centered on the drum shaft 42. A diameter of a circumscribed circle of the triangular prism is smaller than that of the journal portion 37*c*.

A driving device provided in the main body 14 of the apparatus includes a fixed motor 45, a pinion 46 secured to a motor shaft of the motor 45, a rotatably supported intermediate gear 47 meshed with the pinion 46 and a large gear 48, the large gear 48, a large gear shaft 49 secured to the large gear 48 and having a centering portion 57 at its end, a bearing 51 supporting the large gear shaft 49, and a coupling concave shaft 52. However, the intermediate gear 47 may be a plural-stage gear.

The bearing 51 supports the large gear shaft 49 not to shift the latter in the axial direction. A coupling concave portion 52*a* has a twisted regular triangular hole which can be engaged and disengaged with respect to the coupling convex portion 37*d* in the axial direction. When the coupling convex portion 37*d* is engaged by the coupling concave portion 52*a,* edge lines of the twisted regular triangular prism of the coupling convex portion 37*d* are contacted with faces of the twisted regular triangular hole of the coupling concave portion 52*a,* thereby aligning them with each other. The centering portion 57 and the coupling concave portion 52*a* have minute circumferential plays. In this connection, the coupling concave shaft 52 is positioned at a position where it is most shifted toward the process cartridge B, and is supported for retarding movement in opposition to a spring force (detailed explanation will be omitted).

A support portion of a nondriving side of the drum shaft 42 is designed so that the drum shaft 42 cannot be shifted toward the other driving side. As shown, a shaft stop ring 53 is fitted on the drum shaft 42. A bearing 55 contained in the bearing case 54 secured to the front cover 16 secured to the end plate portion 12*i* of the developing frame 12 is fitted on the drum shaft 42 and is prevented from being shifted toward the other driving side of the drum shaft 42 by contacting the shaft stop ring 53 with the bearing case 54 with the interposition of the bearing 55. On the other hand, in the photosensitive drum 7, the shifting movement of the drum flange 37 toward the driving side is limited by the collar 56 fitted onto the journal portion 37*c*. In this arrangement, in order to permit the limited axial movement of the photosensitive drum 7, a distance between the shaft support portion 17*a* and the bearing 55 is selected to be greater than a distance between a surface of the shaft stop ring 53 facing to the shaft support portion 17*a* and a surface of the collar 56 facing to the bearing 55.

Since the driving device is constituted as mentioned above, when the process cartridge B is mounted to the main body 14 of the image forming apparatus, the longitudinal position of the cartridge frame (developing frame 12, front cover 16 and rear cover 17) with respect to the main body 14 of the apparatus is determined. A distal end portion 42*a* of the drum shaft 42 is fitted into a hole 57*a* of the centering portion 57 and the coupling convex portion 37*d* is fitted into the coupling concave portion 52*a*. When the motor 45 is rotated, the pinion 46, intermediate gear 47 and large gear 48 are rotated, with the result that the coupling concave shaft 52 is rotated via the large gear shaft 49 and the centering portion 57. This rotation causes the coupling convex portion 37*d* and the coupling concave portion 52*a* to twist each other in the fitting direction. As a result, since the drum flange 37 and the coupling concave shaft 52 are pulled toward each other, the distal end of the coupling convex portion 37*d* is contacted with the bottom of the coupling concave portion 52*a*. Thus, the axial position of the photosensitive drum 7 is determined with respect to the positioned coupling concave shaft 52.

When the process cartridge B is mounted to the main body 14 of the apparatus, if the coupling convex portion 37*d* is not fitted into the coupling concave portion 52*a,* the end face of the coupling convex portion 37*d* pushes an edge of the mouth of the concave portion 52*a* of the coupling concave shaft 52, thereby retarding the coupling concave shaft 52 in opposition to the spring force biasing toward the process cartridge B. Accordingly, after the process cartridge B is mounted, during prerotation, when the phase of the coupling convex portion 37*d* is matched with the phase of the coupling concave portion 52*a,* these are automatically fitted with each other. Incidentally, in this connection, the end face of the coupling convex portion 37*d* may not abut against the bottom of the coupling concave portion 52*a,* but the flange 37*b* of the drum flange 37 may be pulled toward the shaft support portion 17*a* of the rear cover 17 via the collar 56 by the coupling pull force.

In the illustrated embodiment, while an example that the developing means, electrifying means capable of collecting the toner and the photosensitive drum are assembled as the process cartridge was explained, the support structure of the photosensitive drum with respect to the cartridge frame and engagement/disengagement between the driving force receiving portion of the photosensitive drum and the driving member of the main body of the image forming apparatus can be applied to general process cartridges.

Here, the process cartridge means a structure in which the electrifying means, developing means or cleaning means and the electrophotographic photosensitive member are integrally incorporated as a cartridge unit which can detachably mountable to the main body of the image forming apparatus, or at least one of the electrifying means, developing means and cleaning means and the electrophotographic photosensitive member are integrally incorporated as a cartridge unit which can detachably mountable to the main body of the image forming apparatus, or at least the developing means and the electrophotographic photosensitive member are integrally incorporated as a cartridge unit which can detachably mountable to the main body of the image forming apparatus.

(Driving of developing sleeve)

Figure 21:
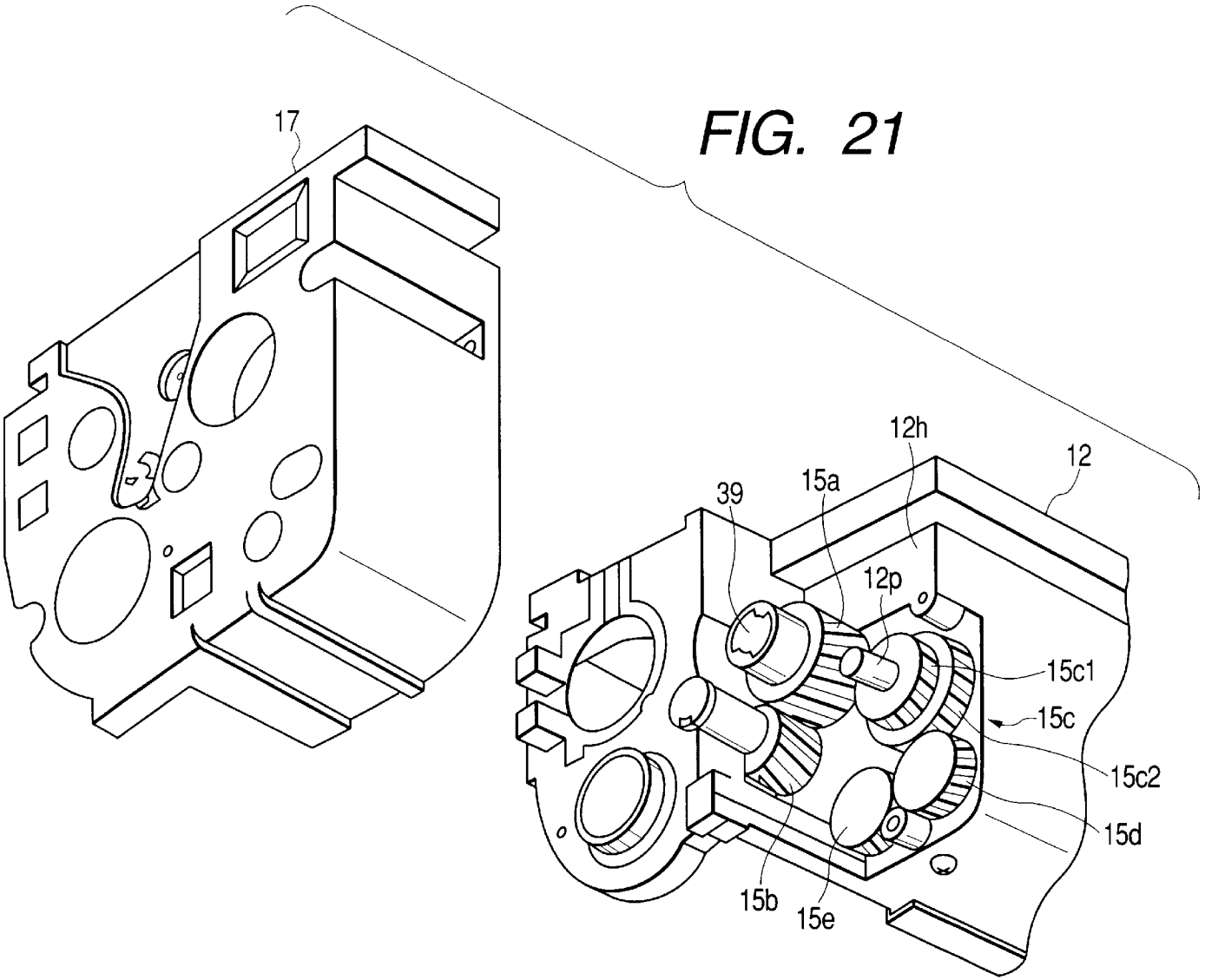
FIG. 21 is a perspective view of the process cartridge, with the rear cover omitted, looked at from a lower oblique rear side.

As shown in FIG. 17, a developing sleeve gear 15*b* is secured to the developing sleeve 10*d* outwardly of the journal portion 10*d*1 in the longitudinal direction. As shown in FIGS. 7, 13 and 21, the developing sleeve gear 15*b* is meshed with a developing portion driving gear 15*a*. The developing portion driving gear 15*a* is formed integrally with a developing portion coupling 39 as a rotational driving force receiving portion and has a cylindrical hole at a center of that side of the developing coupling 39. The cylindrical hole of the developing coupling 39 with the developing portion driving gear 15*a* is rotatably fitted on a longitudinal shaft portion (not shown) provided on the end plate portion 12*h* of the developing frame 12.

The developing portion driving gear 15*a* is meshed with a small gear 15*c*1 of a two-stage gear 15*c*. The two-stage gear 15*c* is fitted onto a longitudinal shaft portion 12*p* integrally provided on the end plate portion 12*h*. A large gear 15*c*2 of the two-stage gear 15*c* is meshed with an agitating gear 15*d* connected to a rear shaft end of the agitating screw 10*g* shown in FIG. 2. The agitating gear 15*d* is meshed with an agitating gear 15*e* connected to a rear shaft end of the agitating screw 10*h*. The agitating gears 15*d*, 15*e* have journals (not shown) intermediate in the axial direction and integrally have connecting portions (not shown) for connection to the agitating screws 10*g*, 10*h* at distal ends thereof, so that the journals are rotatably received and supported by bearing holes (not shown) of the end plate portion 12*h* of the developing frame 12 and the connecting portions are engaged by rear ends of the agitating screws 10*h*, 10*g* to drive the agitating screws 10*g*, 10*h*. Incidentally, bearings for supporting the agitating gears 15*d*, 15*e* will be described later.

Incidentally, front shaft ends of the agitating screws 10*g*, 10*h* have holes, so that, as shown in FIG. 14, the shaft ends are press-fitted into longitudinal holes of the end plate portion 12*i* opposite to the end plate portion 12*h* of the developing frame 12 and the holes of the shaft ends is rotatably fitted onto support shaft 19*g*, 19*h* protruded within the developing frame 12.

In the condition that the process cartridge B is mounted to the main body 14 of the apparatus, when the driving force is transmitted from the main body 14 of the apparatus, the developing portion coupling 39 is rotated. The developing portion driving gear 15*a* integral with the developing portion coupling 39 rotates the developing sleeve gear 15*b*, thereby rotating the developing sleeve 10*d*. Further, the developing portion driving gear 15*a* drives the agitating gear 15*d* via the two-stage gear 15*c*, and the agitating gear 15*d* transmits the rotation to the agitating gear 15*e*. As a result, the agitating screws 10*g*, 10*h* are rotated to agitate the toner while circulating the toner.

The developing sleeve 10*d* is rotated in the same direction as the photosensitive drum 7. Thus, at the opposed area (developing area) between the developing sleeve 10*d* and the photosensitive drum 7, the peripheral surface of the developing sleeve 10*d* is shifted in a direction opposite to a shifting direction of the peripheral surface of the photosensitive drum 7. The spacer rollers 10*j* (FIG. 17) rotatably supported on both ends of the developing sleeve 10*d* are rollingly rotated together with the photosensitive drum 7 and are rotated in a direction opposite to the rotating direction of the developing sleeve 10*d*.

As shown in FIG. 21, the gears 15*a*, 15*b*, 15*c*, 15*d*, 15*e* are covered by the rear cover 17 contacted with and secured to the end plate portion 12*h* of the developing frame 12.

(Support and driving structure of agitating members)

Figure 22:
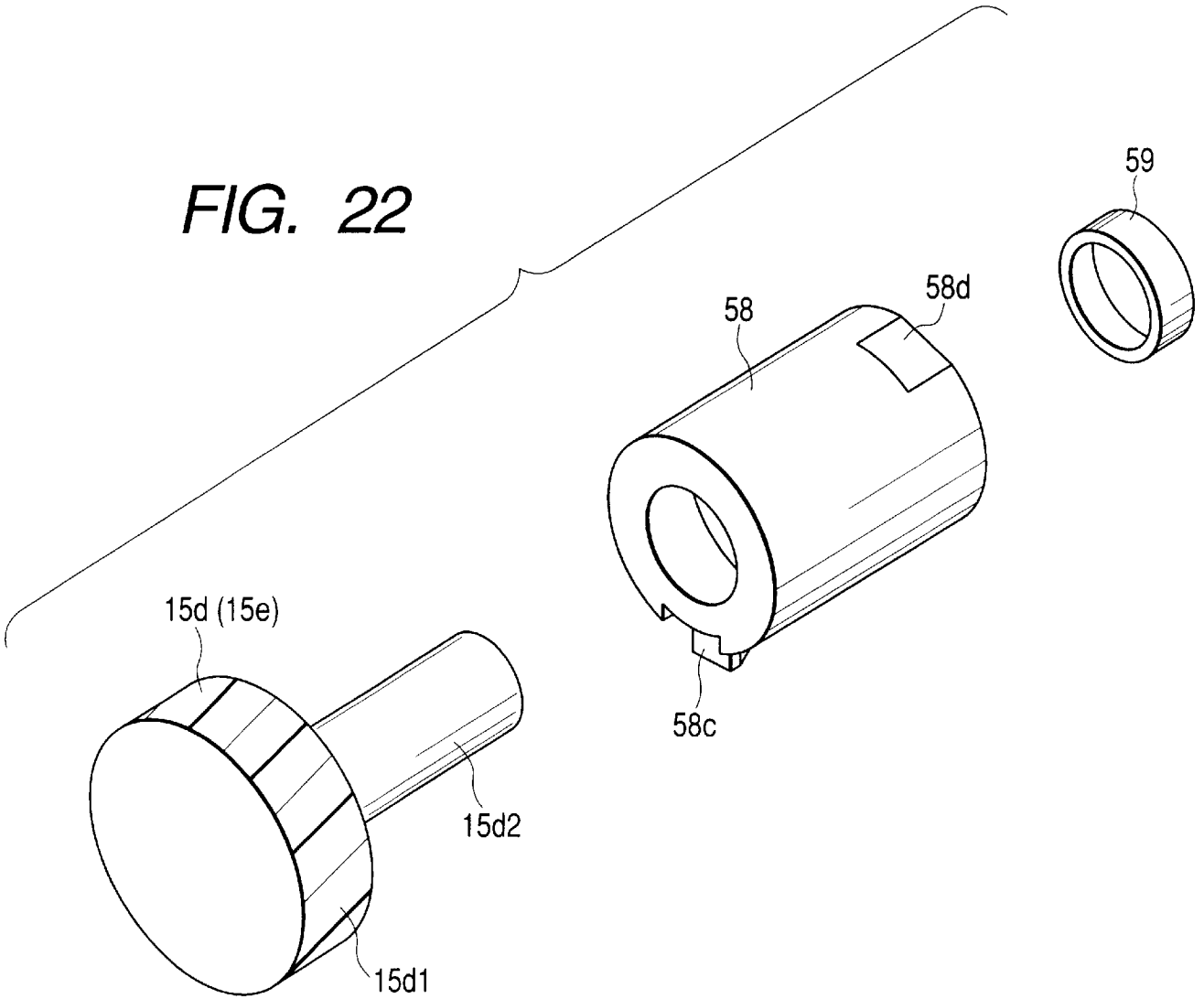
FIG. 22 is a perspective view showing assembling of a bearing member.
Figure 24:
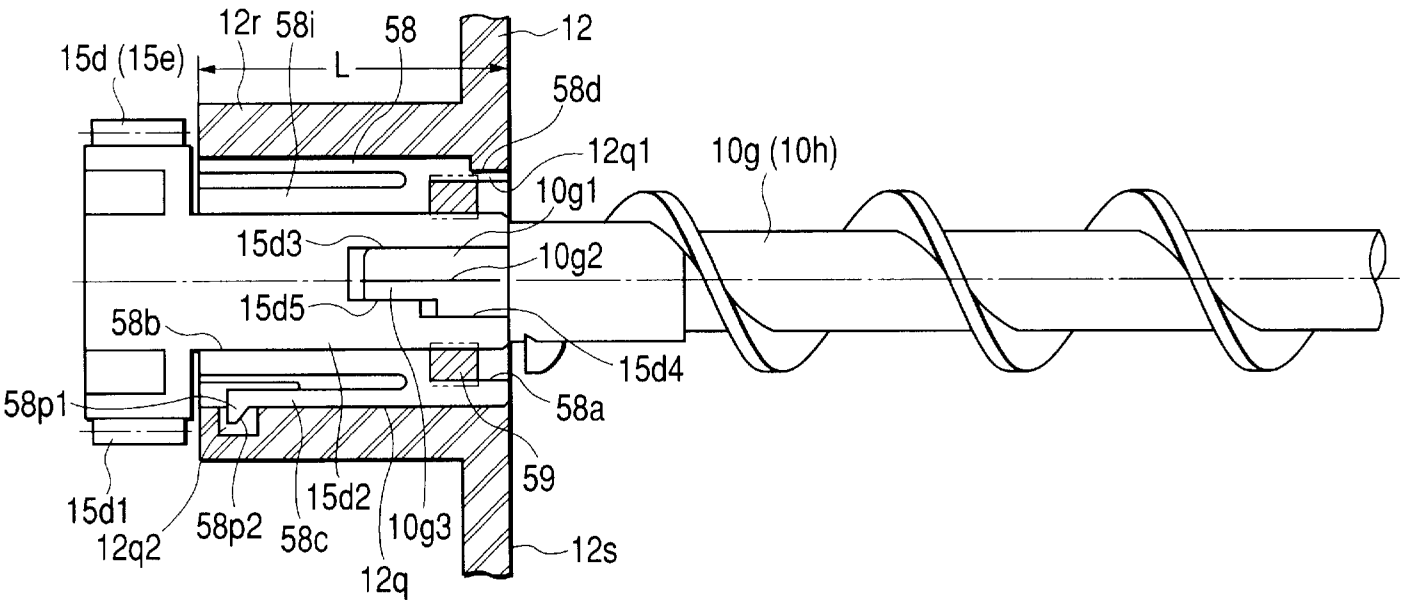
FIG. 24 is a sectional view showing a connection between an agitating screw and an agitating gear.

In the illustrated embodiment, since the agitating gears 15*d* and 15*e* are identical, only the agitating gear 15*d* will be explained. As shown in FIGS. 22 and 24, the agitating gear 15*d* has a toothed portion 15*d*1 and a journal portion 15*d*2. The journal portion 15*d*2 is provided at its distal end with a coupling hole 15*d*3 into which a shaft end 10*g*1 of the agitating screw 10*g* is fitted. The hole 15*d*3 is a cylindrical hole having a mouth centered on the journal portion 15*d*2, and the bottom of the cylindrical hole is a D-cut shaped hole 15*d*5 having the same diameter as that of the cylindrical hole. A length of the journal portion 15*d*2 is substantially the same as a length from an outer end of a bearing house 12*r* provided outside of the developing frame 12 to an inner face 12*s* of the developing frame 12.

Figure 23:
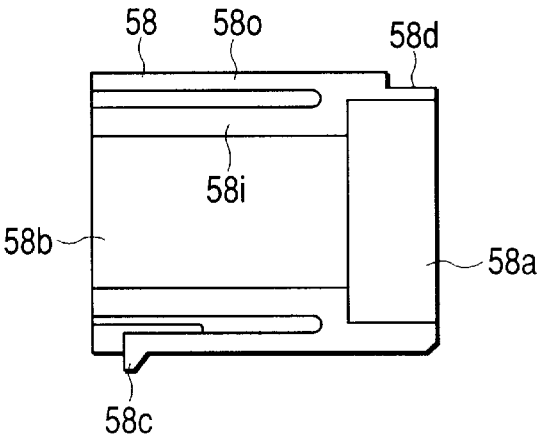
FIG. 23 is a longitudinal sectional view of the bearing member.

As shown in FIG. 23, the bearing 58 as the bearing member has a small diameter hole 58*b* corresponding to an inner diameter of an inner cylinder 58*i* of an outer/inner double cylinder, and a large diameter hole 58*a* contiguous with the small diameter hole 58*b* and directing toward the interior of the developing frame 12 and having a diameter greater than the diameter of the small diameter hole 58*b*. The small diameter hole 58*b* of the bearing 58 serves to slidingly receive the journal portion 15*d*2. The large diameter hole 58*a* is a seal member attaching hole into which a seal member 59 is press-fitted, and this portion has a single cylindrical shape.

An outer diameter of the bearing 58 is substantially cylindrical. A length of the bearing 58 is equal to a length L of the developing frame 12. A D-cut portion 58*d* is provided on an axial end of the bearing 58 and directing toward the interior of the developing frame 12.

A D-cut hole portion 12*q*1 having the same section and same axial width as those of the D-cut portion 58*d* and facing toward the interior of the developing frame 12 is provided in a hole 12*q* as a substantially cylindrical through-hole positioned at the center of the bearing house 12*r* to just receive the D-cut portion 58*d*.

Figure 25:
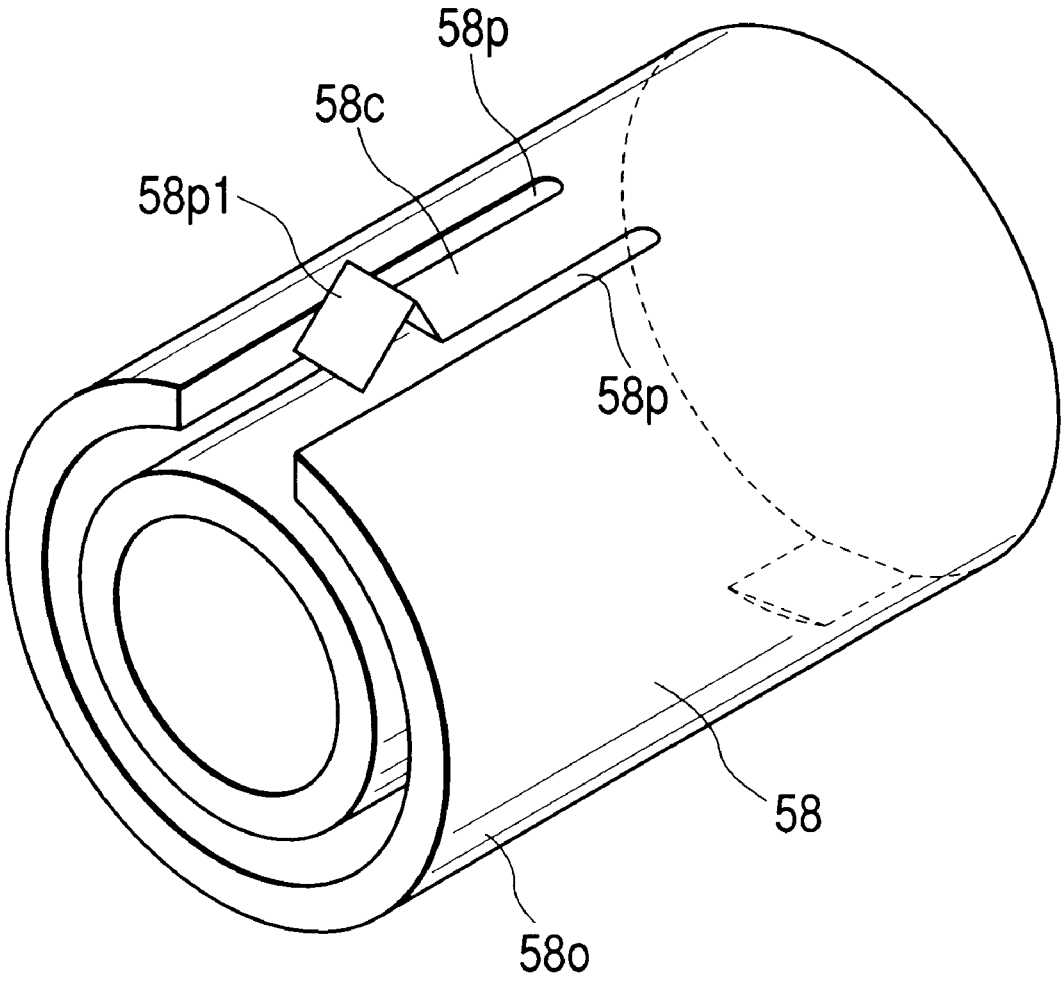
FIG. 25 is a perspective view of the bearing member.

A cantilever support member 58*c* is provided on an outer periphery of the bearing 58 at a position opposite to the D-cut portion 58*d* in circumferential and axial directions. As shown in FIG. 25, there are two slits 58*p* parallel with a generating line of an outer cylinder 50*o*, and the cantilever support member 58*c* is defined between the slits 58*p*. The cantilever support member 58*c* is positioned on an extension of the outer periphery of the outer cylinder 58*o* except for a distal end. The distal end 58*p*1 of the cantilever support member 58*c* is protruded from the outer periphery of the outer cylinder 58*o* radially outwardly. In an assembled condition, the distal end protrusion 58*p*1 is fitted into a small hole 12*q*2 formed in the hole 12*q* of the bearing house 12*r*. The small hole 12*q*2 may pass through the bearing house 12*r* in the radial direction.

An shaft end 10*g*1 of the agitating screw 10*g* provided as the agitating member in the illustrated embodiment has a cylindrical proximal portion 10*g*2 fitted into a cylindrical portion 15*d*4 of the coupling hole 15*d*3 of the agitating gear 15*d*, and a D-cut shaft portion 10*g*3 just fitted into the D-cut hole 15*d*5.

For example, an oil seal may be used as the seal member 59, and a lip has a dimension that it can penetrate into the journal portion 15*d*2.

In this connection, when the gear portion 15*d*1 is rotated by the driving force, the agitating screw 10*g* is rotated. The seal member 59 serves to seal the toner within the developing frame 12.

The agitating screw 10*h* is supported and driven in the same manner as mentioned above.

(Assembling Method of Agitating Member)

When the seal member 59 is attached to the bearing 58, as shown in FIGS. 22 and 23, the seal member 59 is shifted up to that side of the large diameter hole 58*a* and is urged against a step between the large diameter hole 58*a* and the small diameter hole 58*b*. The outer diameter of the seal member 59 is reduced by the large diameter hole 58*a*, as shown by the two-dot and chain line in FIG. 24. Here, journal 15*d*2 of the agitating gear 15*d* is fitted into the inner cylinder 58*i* of the bearing 58. In this case, due to the outer diameter of the journal portion 15*d*2 of the agitating gear 15*d* (or 15*e*), the inner diameter of the seal member 59 is assembled in a slightly compressed condition. As a result, the toner is prevented from leaking between the bearing 58 and the agitating gear 15*d* (or 15*e*). In a condition that the seal member 59 and the agitating gear 15*d* are assembled in this way, the bearings 58 are assembled into the both end through-holes 12*q* of the developing frame 12 from outside, thereby connecting the agitating gears 15*d*, 15*e* to the agitating screws 10*g*, 10*h*. The large diameter hole 58*a*, small diameter hole 58*b* and through holes 12*q* of the developing frame 12 are coaxial.

In this case, as shown in FIGS. 23 and 24, the bearing 58 has the cantilever support member 58*c* and the D-cut portion 58*d* and is fixedly supported by the developing frame 12 so that the bearing is not rotated by the longitudinal positioning and the rotation of the agitating gear 15*d* (or 15*e*) connected to the agitating screws 10*g* (or 10*h*). Further, the bearing 58 is fitted into the through-hole 12*q* of the developing frame 12 to prevent toner leakage.

Further, explaining in detail, the bearing 58 to which the agitating gear 15*d* and the seal member 59 were assembled is positioned and prevented from being shifted toward the interior of the developing frame 12 by fitting the D-cut portion 58*d* into the D-cut hole 12*q*1 of the bearing house 12*r*. At the same time, the fitting between the D-cut portion 58*d* and the D-cut hole 12*q*1 provides the positioning of the bearing 58 and prevention of rotation of the bearing with respect to the hole 12*q* of the bearing house 12*r* in the circumferential direction.

Further, at a last stage of insertion of the bearing 58 into the hole 12*q*, an inclined introduction portion 58*p*2 of the protrusion 58*p*1 is pushed by the edge of the inlet of the hole 12*q* to shift the distal end protrusion 58*p*1 of the cantilever support member 58*c* toward the center of the bearing 58. When the protrusion 58*p*1 enters into the hole 12*q* and reaches the small hole 12*q*2, the protrusion is restored by the elastic force of the cantilever support member 58*c* to be inserted into the small hole 12*q*2. As a result, the bearing 58 cannot be shifted so long as any tool is not used.

Similar to the assembling, in the disassembling, the bearing 58 is removed together with the agitating gear 15*d* and the seal member 59. In the illustrated embodiment, a disassembling tool is a specific tool. If the small hole 12*q*2 is a through-hole or if the agitating gear 14*d* is provided with an axial through-hole which can face to the cantilever support member 58*c*, a driver is used. In FIG. 24, the removal of the bearing is effected by pushing the distal end protrusion 58*p*1 of the cantilever support member 58*c* toward the radial direction center of the bearing 58 and by removing the protrusion 58*p*1 from the small hole 12*q*2 and by pulling the agitating gear 15*d* outwardly of the developing frame 12 in the axial direction.

In this way, the bearing can be removed together with the agitating gear 15*d* and the seal member 59.

Further, a diameter of the vane (spiral portion) of the agitating screw is selected to be smaller than the through-hole 12*q* of the developing frame 12, so that, in a condition that the bearing 58 is removed from the through-hole 12*q*, the agitating screw 19*g* can be removed through the through-hole 12*q*. Thus, the maintenance and recycle of the developing device can be facilitated.

Figure 26:
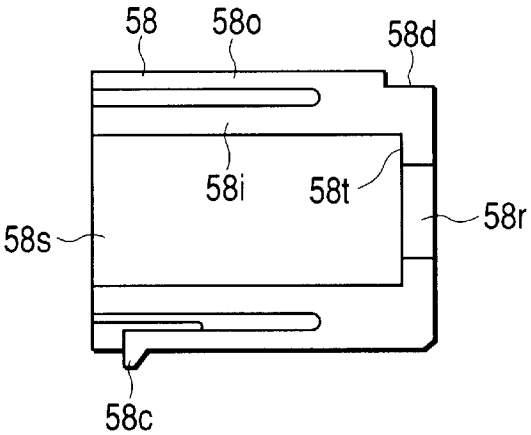
FIG. 26 is a longitudinal sectional view of a bearing member according to another embodiment of the present invention.

Further, in place of the bearing 58 shown in FIG. 23, a bearing as shown in FIG. 26 may be used.

Figure 27:
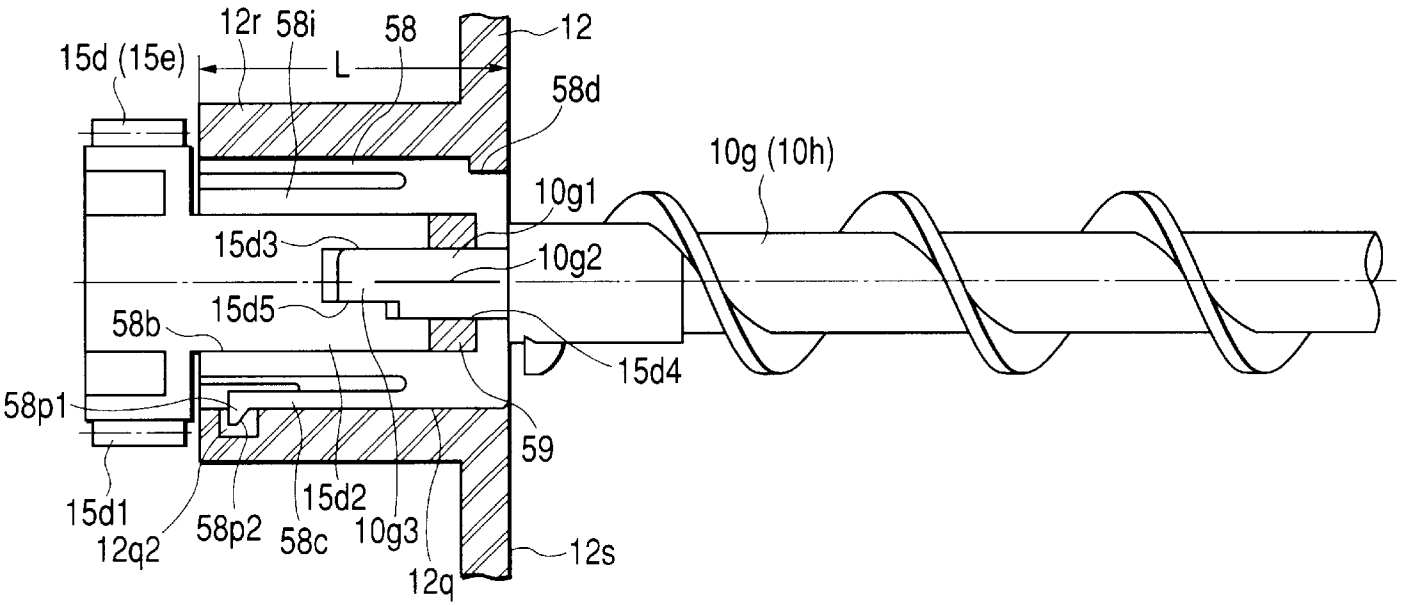
FIG. 27 is a sectional view showing a connection between an agitating screw and an agitating gear according to another embodiment.

The bearing shown in FIG. 26 has a hole 58*r* having a diameter slightly smaller than the diameter of the shaft end 10*g*1 of the agitating screw 10*g*. A seal member 59 having a hole coaxial with the hole 58*r* is mounted on a bottom surface 58*t* of a large diameter hole 58*s* of the bearing 58 from the agitating gear 15*d* side. FIG. 27 shows a condition that the bearing on which the agitating screw 10*g* and the seal member 59 are mounted, and the agitating gear 15*d* are attached to the developing device.

Also with this arrangement, the bearing can be mounted and dismounted together with the agitating gear and the seal member with respect to the frame 12 of the developing device. Further, the agitating screw 10*g* can be removed through the through-hole 12*q*.

In the illustrated embodiment, while the process cartridge of so-called cleaner-less type was explained, the present invention can, of course, be applied to a process cartridge having cleaning means.

As mentioned above, according to the present invention, since the assembling ability for the bearing member, drive transmitting member and agitating member is enhanced and the bearing member can be removed from the developing apparatus, the cleaning of the through-hole of the bearing, exchanging of the seal member (if provided) and exchanging the agitating member can be facilitated.

The present invention is not limited to the above-mentioned embodiments, but various alterations and modifications can be made within the scope of the invention.

What is claimed is:

1. A developing apparatus comprising:

a developer container;

an agitating member for agitating developer contained in said developer container;

a drive transmitting member for transmitting power to said agitating member by engaging a rotary shaft of said agitating member; and a bearing adapted to rotatably hold said drive transmitting member, said bearing being attached to said developer container;

wherein said bearing includes dislodgement preventing means for preventing said bearing from being dislodged from said developer container, and wherein said bearing includes a notched portion having a rotation regulating and positioning function for said developer container.

2. A developing apparatus according to claim 1, wherein, when said bearing is attached to said developer container, said dislodgment preventing means is elastically deformed to be engaged by said developer container.

3. A developing apparatus according to claim 1, further comprising a seal member for preventing the developer from leaking from said developer container between said bearing and said rotary shaft, and wherein said seal member is compressed between said bearing and said drive transmitting member.

4. A developing apparatus according to claim 1, further comprising a seal member for preventing the developer from leaking from said developer container between said bearing and said rotary shaft, and wherein said seal member is compressed between said bearing and said rotary shaft.

5. A developing apparatus according to claim 1, wherein said developer container has a hole formed therein for attaching said bearing, and said agitating member is removable through said hole.

6. A developing apparatus according to claim 1, wherein said developing apparatus is provided in a process cartridge, which is detachably mountable to an image forming apparatus.

7. A developing apparatus according to claim 6, wherein said process cartridge includes an image bearing member and electrifying means for electrifying said image bearing member and said developing apparatus.

8. A developing apparatus according to claim 7, wherein said process cartridge further includes cleaning means for cleaning said image bearing member.

* * * * *

UNITED STATES PATENT AND TRADEMARK OFFICE

CERTIFICATE OF CORRECTION

PATENT NO. : 6,587,660 B2
DATED : July 1, 2003
INVENTOR(S) : Takahito Ueno et al.

It is certified that error appears in the above-identified patent and that said Letters Patent is hereby corrected as shown below:

Drawings,
Figure 2, “SENTER)” should read -- CENTER) --.

Column 1,
Line 32, “an” should read -- a --.

Column 5,
Line 11, “to” should read -- to the --;
Line 16, “driven” should read -- driving --;
Line 38, “is remaining” should read -- remains --;
Line 45, “almost causes” should read -- most cases --; and
Line 46, “is remained” should read -- remains --.

Column 6,
Line 14, “view” (second occurrence) should read -- views --; and
Lines 46 and 47, “attachement” should read -- attachment --.

Column 7,
Line 53, “against” should read -- against the --.

Column 8,
Line 23, “therearound” should read -- there around --;
Lines 26 and 51, “the both” should read -- both --;
Line 33, “The both” should read -- Both --; and
Line 54, “cartridge)” should read -- cartridge --.

Column 10,
Line 26, “to the” should read -- the --.

Column 11,
Lines 14 and 17, “can” should read -- can be --.

Column 12,
Line 48, “directing” should read -- directed --.

UNITED STATES PATENT AND TRADEMARK OFFICE

CERTIFICATE OF CORRECTION

PATENT NO. : 6,587,660 B2
DATED : July 1, 2003
INVENTOR(S) : Takahito Ueno et al.

It is certified that error appears in the above-identified patent and that said Letters Patent is hereby corrected as shown below:

Column 13,
Line 3, "An" should read -- A --.

Signed and Sealed this

Twenty-third Day of December, 2003

JAMES E. ROGAN
*Director of the United States Patent and Trademark Office*